US011530888B2

(12) United States Patent
Underwood et al.

(10) Patent No.: US 11,530,888 B2
(45) **Date of Patent: *Dec. 20, 2022**

(54) MAGAZINE FOLLOWER

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/331,783

(22) Filed: May 27, 2021

(65) Prior Publication Data

US 2021/0285737 A1 Sep. 16, 2021

Related U.S. Application Data

(63) Continuation of application No. 16/736,771, filed on Jan. 7, 2020, now Pat. No. 11,054,202.

(51) Int. Cl.
*F41A 9/71* (2006.01)
*F41A 9/70* (2006.01)

(52) U.S. Cl.
CPC . *F41A 9/71* (2013.01); *F41A 9/70* (2013.01)

(58) Field of Classification Search
CPC ..... F41A 9/65; F41A 9/71; F41A 9/69; F41A 9/64; F41A 9/61; F41A 9/70
USPC ..... 42/49.02, 49.01, 50
See application file for complete search history.

(56) References Cited

U.S. PATENT DOCUMENTS

| | | | | |
|---|---|---|---|---|
| 1,804,511 | A | 5/1931 | Pedersen | |
| 3,226,869 | A | 1/1966 | Musgrave | |
| 3,465,463 | A * | 9/1969 | Batezell | F41A 17/38 42/50 |
| 3,772,812 | A | 11/1973 | Day | |
| 4,888,899 | A | 12/1989 | Chesnut et al. | |
| 5,386,657 | A | 2/1995 | Racheli | |
| 6,070,352 | A | 6/2000 | Daigle | |
| 8,028,455 | B1 | 10/2011 | Battaglia | |
| 8,689,475 | B2 | 4/2014 | Battaglia | |
| 9,194,635 | B1 | 11/2015 | Gibbens et al. | |
| 9,347,721 | B2 | 5/2016 | Larson, Jr. | |
| 9,523,546 | B1 | 12/2016 | Harding | |
| 9,784,512 | B1 | 10/2017 | Harding | |
| 10,066,886 | B2 | 9/2018 | Vilardi et al. | |
| 10,222,153 | B1 | 3/2019 | Harding | |
| 10,254,063 | B2 | 4/2019 | Duhon | |
| 10,260,827 | B2 | 4/2019 | Mock | |
| 2007/0199435 | A1 | 8/2007 | Hochstrate et al. | |
| 2010/0126053 | A1* | 5/2010 | Fitzpatrick | F41A 9/69 42/50 |
| 2011/0113663 | A1 | 5/2011 | Nakayama et al. | |

(Continued)

OTHER PUBLICATIONS

Jeff Gurwitch; AR Magazines: Separating the Good From the Bad; S. W. A. T. Magazine; accessed online Dec. 19, 2019; https://www.swatmag.com/article/ar-magazines-separating-good-bad/.

*Primary Examiner* — John Cooper

(57) ABSTRACT

A follower for a magazine of a firearm includes an underside for attachment to a spring within the magazine, a spine extending downward from a rear part of the follower, and an upper surface for interfacing with at least one cartridge inserted into the magazine. The upper surface includes a top portion and a bottom portion, and the bottom portion includes a curved surface.

21 Claims, 23 Drawing Sheets

(56) References Cited

U.S. PATENT DOCUMENTS

| | | | | |
|---|---|---|---|---|
| 2013/0086834 | A1 | 4/2013 | Battaglia | |
| 2013/0247437 | A1* | 9/2013 | Obermeit | F41A 9/69 42/49.01 |
| 2014/0373416 | A1 | 12/2014 | Barnhart | |
| 2015/0068089 | A1 | 3/2015 | Mock et al. | |
| 2015/0241162 | A1* | 8/2015 | Geraghty | F41A 35/02 42/6 |
| 2016/0282071 | A1 | 9/2016 | Vilardi et al. | |
| 2017/0307319 | A1 | 10/2017 | Jarboe | |
| 2018/0180371 | A1 | 6/2018 | Beasley | |
| 2019/0226779 | A1 | 7/2019 | DiChario et al. | |
| 2019/0331444 | A1 | 10/2019 | Underwood et al. | |
| 2019/0353441 | A1 | 11/2019 | Underwood et al. | |

* cited by examiner

MAGAZINE FOLLOWER

CROSS REFERENCE TO RELATED APPLICATIONS

This application is a continuation of U.S. patent application Ser. No. 16/736,771 ("the '771 application") filed Jan. 7, 2020. This application is also related to U.S. patent application Ser. No. 16/397,546 ("the '546 application"), filed on Apr. 29, 2019 and U.S. patent application Ser. No. 17/019,854 ("the '854 application"), filed on Sep. 14, 2020. The '771 application, '546 application, and the '854 application are each hereby incorporated in their entirety by this reference.

FIELD OF THE INVENTION

The field of the invention relates to firearms, particularly methods and devices for followers and magazines of a firearm.

BACKGROUND

Since the advent and standardization of self-contained metallic cartridge ammunition, firearms have included systems and devices for loading and/or storing ammunition. Many modern firearms (including handguns, rifles, carbines, shotguns, etc.) include a magazine for storing and/or feeding ammunition. Magazines may be integral/fixed to the firearm or may be detachable. Different magazine arrangements include tube, box, rotary, drum, casket, pan, helical, saddle-drum, or various other arrangements.

In some cases, particular firearm designs may be adapted to function with various calibers. For example, the popularity of AR-15 variant (civilian) or M16/M4 (military) firearms has inspired numerous variations for different calibers. Most typical AR-15 firearms are chambered for 5.56×45 mm NATO and/or .223 Remington. Many receivers and/or magazines may be modified to operate with 300 BLK (7.62×35 mm). However, conventional designs intended to use other calibers require a different receiver, modification to the receiver, and/or a different magazine. Accordingly, it may be desirable to retrofit a conventional magazine with an assembly such that a conventional magazine and a conventional receiver can be used with alternative caliber ammunition.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a follower for a magazine of a firearm comprises: an underside for attachment to a spring within the magazine; a spine extending downward from a rear part of the follower; an upper surface for interfacing with at least one cartridge inserted into the magazine, wherein: the upper surface comprises a top portion and a bottom portion; and the bottom portion comprises a curved surface.

According to certain embodiments of the present invention, a magazine for a firearm comprises: a follower and a spring attached to an underside of the follower, wherein the follower comprises: a spine extending downward from a rear part of the follower; an upper surface for interfacing with at least one cartridge inserted into the magazine, wherein: the upper surface comprises a top portion and a bottom portion; and the bottom portion comprises a curved surface.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1-10B focus on assemblies for box magazines for semi-automatic rifles/carbines, the features, concepts, and functions described herein are also applicable (with potential necessary alterations for particular applications) to magazines for other firearms including handguns, shotguns, or any other type of firearm. The magazine assembly 100, 200 described herein may be retrofitted into a conventional magazine to allow the magazine to be compatible with a different size, configuration, and/or caliber of ammunition (compared to the original intended design of the magazine). In some embodiments, as opposed to retrofitting an existing magazine, the magazine assembly 100, 200 may be the internal structure of a magazine such that the magazine assembly 100, 200 is integrally molded, formed, and/or machined into the magazine. The magazine assembly 100, 200 may function to make a magazine (either by retrofitting a conventional magazine or as part of a newly manufactured magazine) compatible with shorter/longer cartridges, smaller/larger diameter cartridges, and/or other changes in configuration of a cartridge. In some examples, the magazine assembly 100, 200 is compatible with conventional magazines and/or various commercially available magazines, such as a Standardization Agreement (STANAG) magazine, designed for 5.56×45 mm NATO ammunition or is part of a new magazine with a similar form factor such that the new magazine is compatible with firearms designed for such conventional magazines. The new magazine including the magazine assembly 100, 200 or a retrofitted conventional magazine including the magazine assembly 100, 200 ensure that the magazine is compatible with handgun caliber ammunition, such as 9×19 mm, .45 ACP, .40 S&W, .380 ACP, .38 ACP, .38 Super, .22 Long Rifle, other handgun calibers, or any other reasonable caliber of ammunition.

Figure 1:
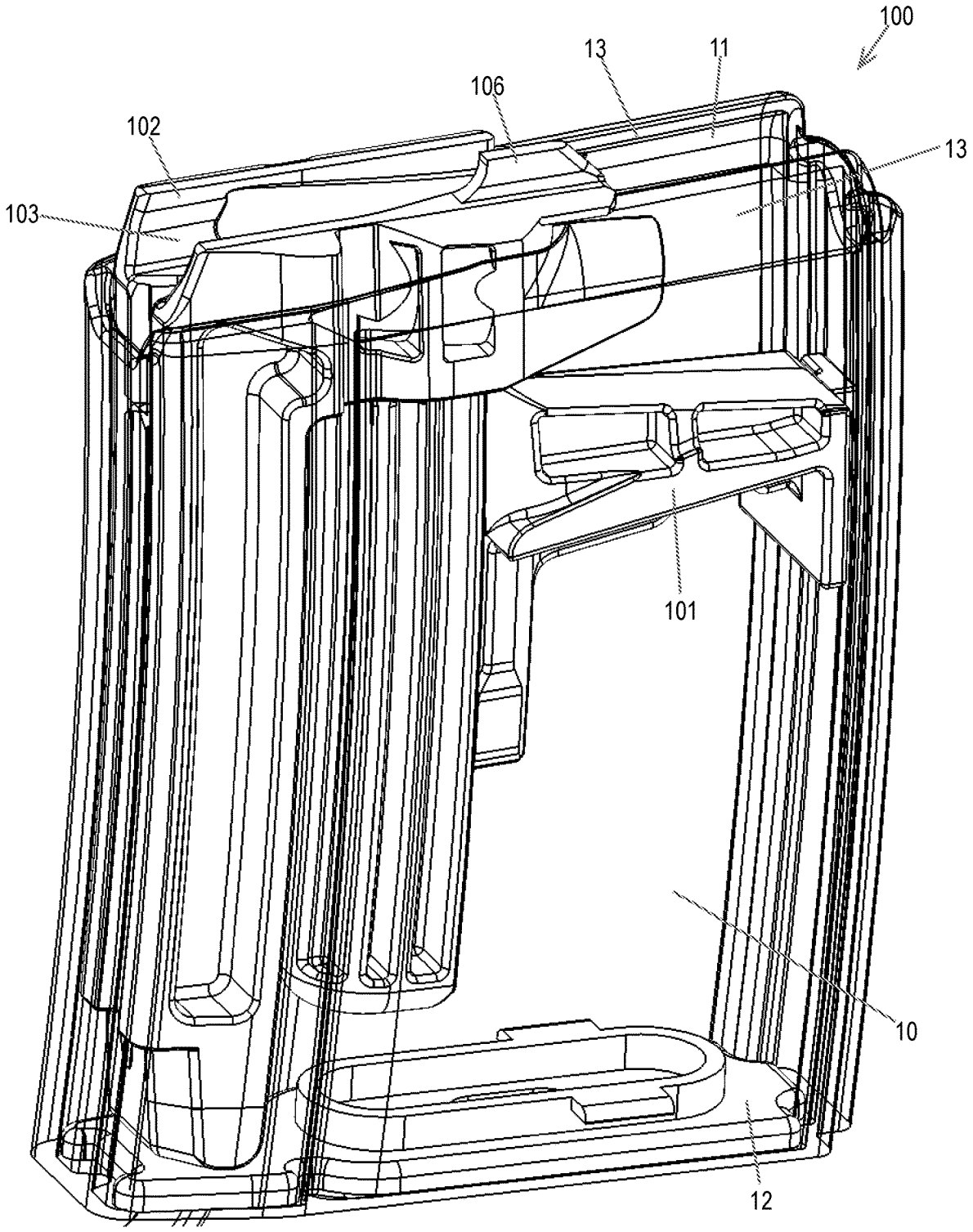
FIG. 1 is a perspective view of a magazine assembly, according to certain embodiments of the present invention.
Figure 2:
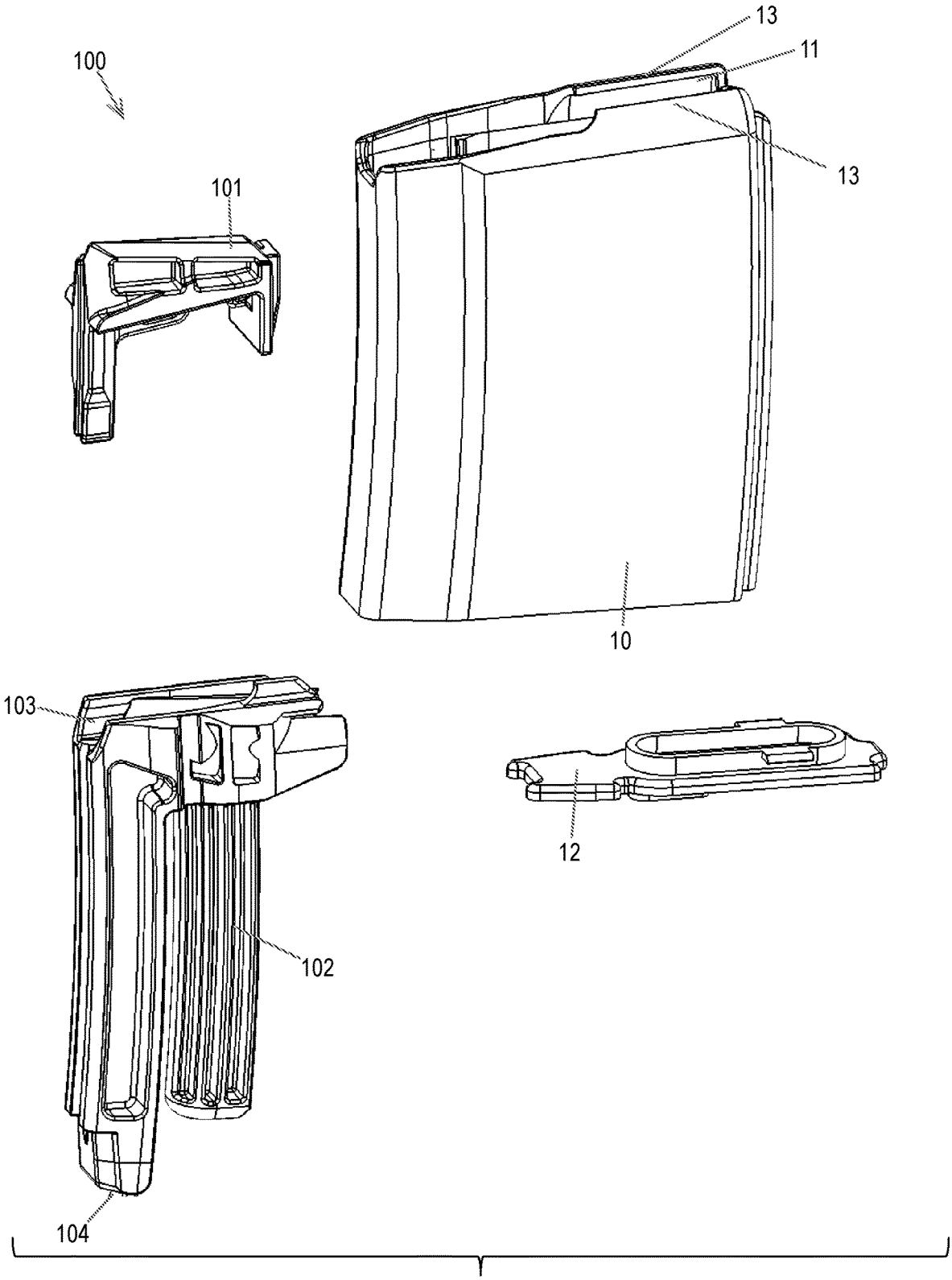
FIG. 2 is an exploded perspective view of the magazine assembly of FIG. 1.

According to certain embodiments of the present invention, as shown in FIGS. 1-2, a magazine assembly 100 may interface with a receiver of a firearm. For example, the magazine assembly 100 may be inserted into a magazine well of a lower receiver of a firearm. The magazine assembly 100 may be a portable device capable of being inserted into and removed from a firearm (e.g., into a magazine well) or may be permanently attached. The magazine assembly 100 facilitates the loading of at least one round of ammunition into the firearm. The magazine assembly 100 may facilitate the loading of 10 rounds, 15 rounds, 30 rounds, or any other desired number of rounds.

In some embodiments of the present invention, as shown in FIGS. 1 and 2, the magazine assembly 100 is located within a main body 10 where a floorplate 12 is removably attached to the lower end of the main body 10. The magazine assembly 100 may include a follower 101 located inside the main body 10, an insert 102 located inside the main body 10, and a spring (not shown) disposed inside the main body 10 extending between the floorplate 12 and the follower 101. The main body 10 may include an upper opening 11 for the magazine and at least one feed lip 13 at an upper end. In some embodiments, the magazine assembly 100 may include an extension (not shown) attached to the lower end of the main body 10 with the floorplate 12 attached to the lower end of the extension. This extension allows the user to adjust the number of cartridges that will fit in the magazine assembly 100. In some cases, the magazine assembly 100 includes the follower 101 and the insert 102, which are retrofitted into a conventional magazine body.

Figure 3A:
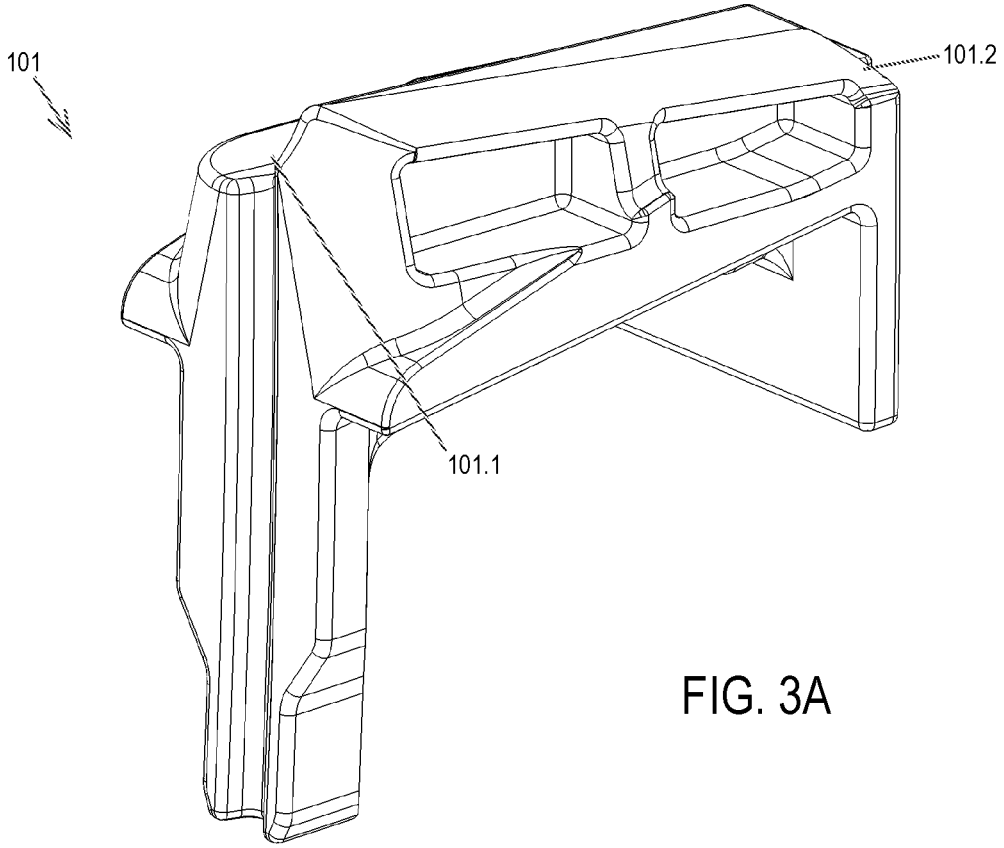
FIGS. 3A and 3B are perspective views of a follower of the magazine assembly of FIG. 1.
Figure 3B:
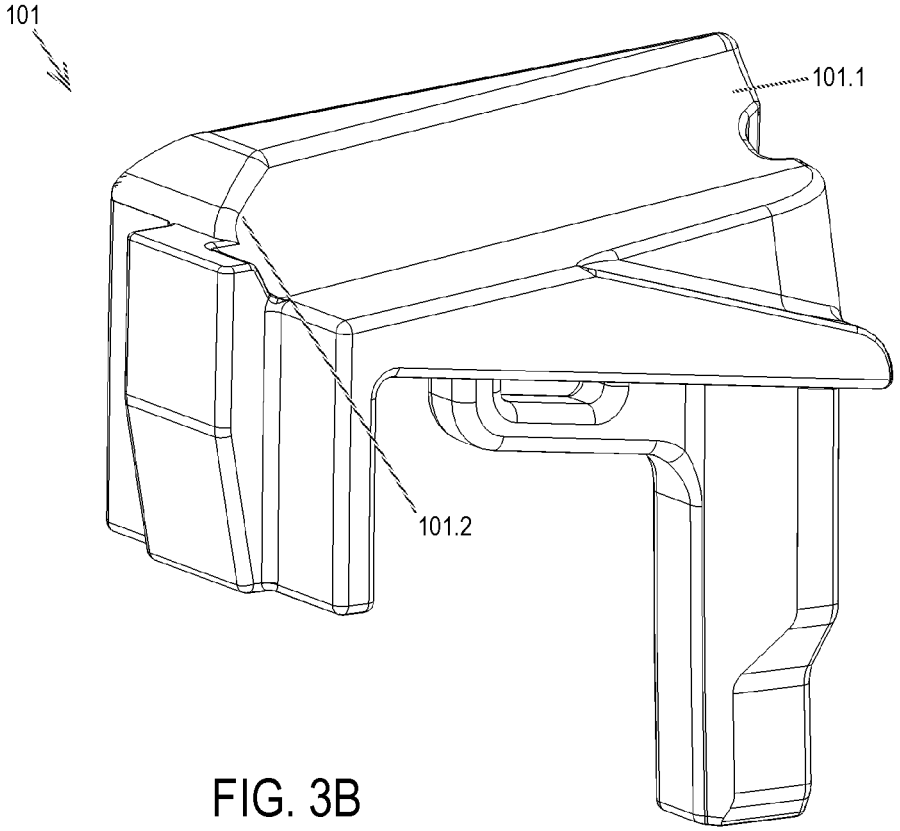

As shown in FIGS. 3A and 3B, the follower 101 may include a leading edge 101.1 and a trailing edge 101.2. The follower 101 may be attached to a spring that extends between the follower 101 and the floorplate 12 such that the spring may be attached to the underside of the follower 101. The follower may be capable of moving up and down inside the main body of the magazine assembly 100. In some embodiments, the size and features of the follower 101 correspond with the size of the insert 102 and the type of ammunition chosen. In some embodiments, the follower 101 is configured to operate with handgun caliber cartridges and the insert 102 is configured to reduce the length (i.e., distance between the leading and trailing ends) of an open area inside the main body from a length appropriate for rifle caliber cartridges to a length appropriate for handgun caliber cartridges.

As shown in FIG. 1 (where the main body is shown transparent), the insert 102 extends a full height of the main body 10 (between the floorplate 12 and the opening 11) and a full width of the main body. The insert 102 does not extend a full length of the main body 10. The insert 102 alters the length of the open area inside the main body 10 (i.e., the length between the leading edge and the trailing edge of the magazine), which allows a conventional magazine body to be used with the magazine assembly 100. The insert 102 and follower 101 together approximately correspond to the length of the interior of the main body (i.e., the length between the leading edge and the trailing edge). The insert 102 and the follower 101 may be available in multiple sizes/configurations in order accommodate a wide variety of ammunition. The insert 102 may include a channel 103 at an upper end of the insert 102. In some cases, the channel 103 extends above the main body 10. The channel 103 guides the cartridge from the follower 101 toward the chamber as the cartridge moves forward. For example, in some embodiments, the bolt carrier group 304 of the firearm (see FIGS. 11A and 11B) pushes the cartridge forward from the follower into the channel 103. In some cases, the channel 103 acts as a feed ramp (or a portion of a feed ramp) where the cartridge moves through the channel 103 from the trailing edge 103.2 toward the leading edge 103.1 of the channel 103. The insert 102 may optionally include a small curved protrusion 104 (see FIGS. 4A and 4B) that extends from the bottom of the insert 102 and may press against the inside surface of the floorplate 12 to act as a spring to push the insert toward the top of the magazine assembly 100. In some cases, the insert 102 is fixed in position when the floorplate 12 pushes against a lower surface of the insert 102.

Figure 4A:
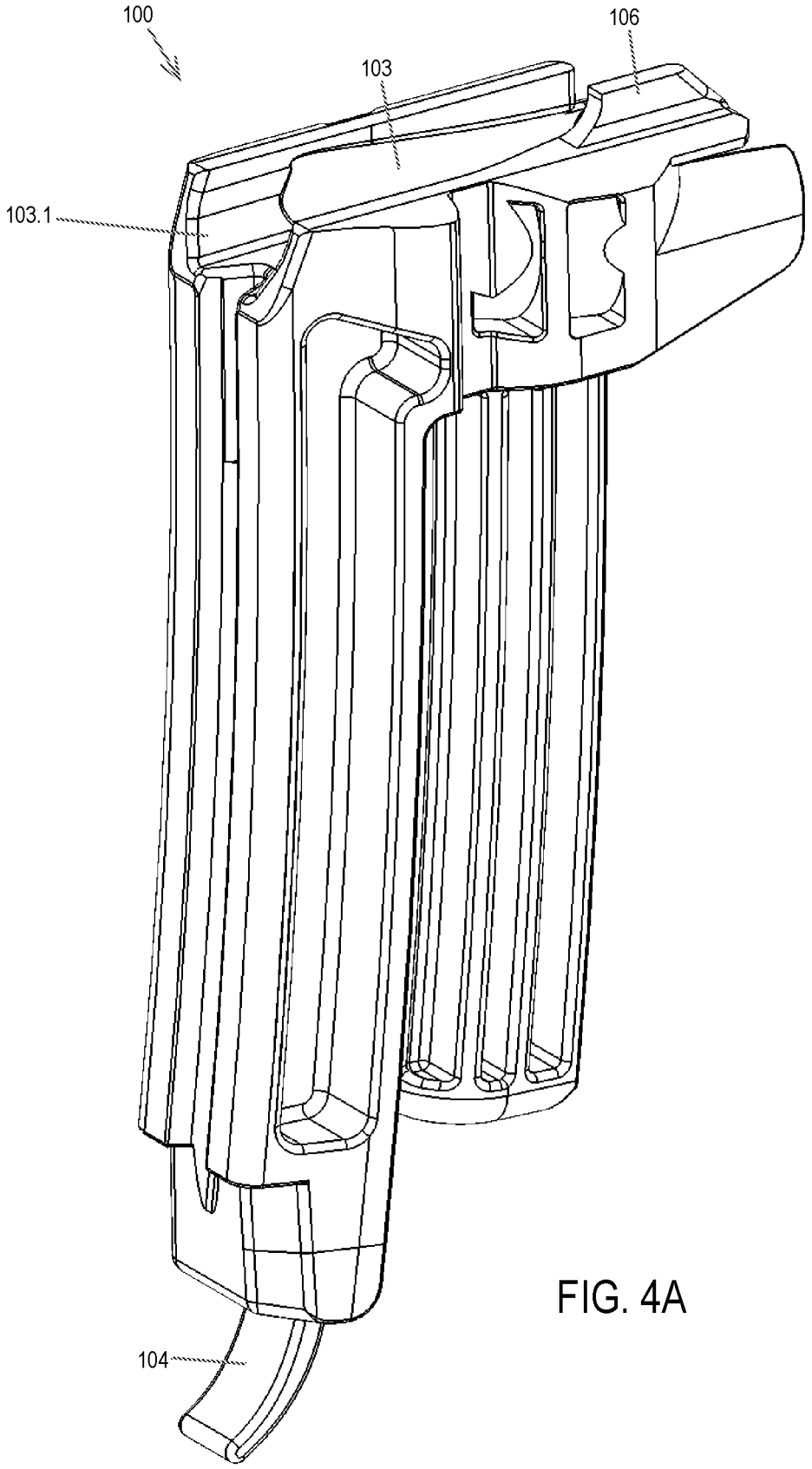
FIGS. 4A and 4B are perspective views of an insert of the magazine assembly of FIG. 1.
Figure 4B:
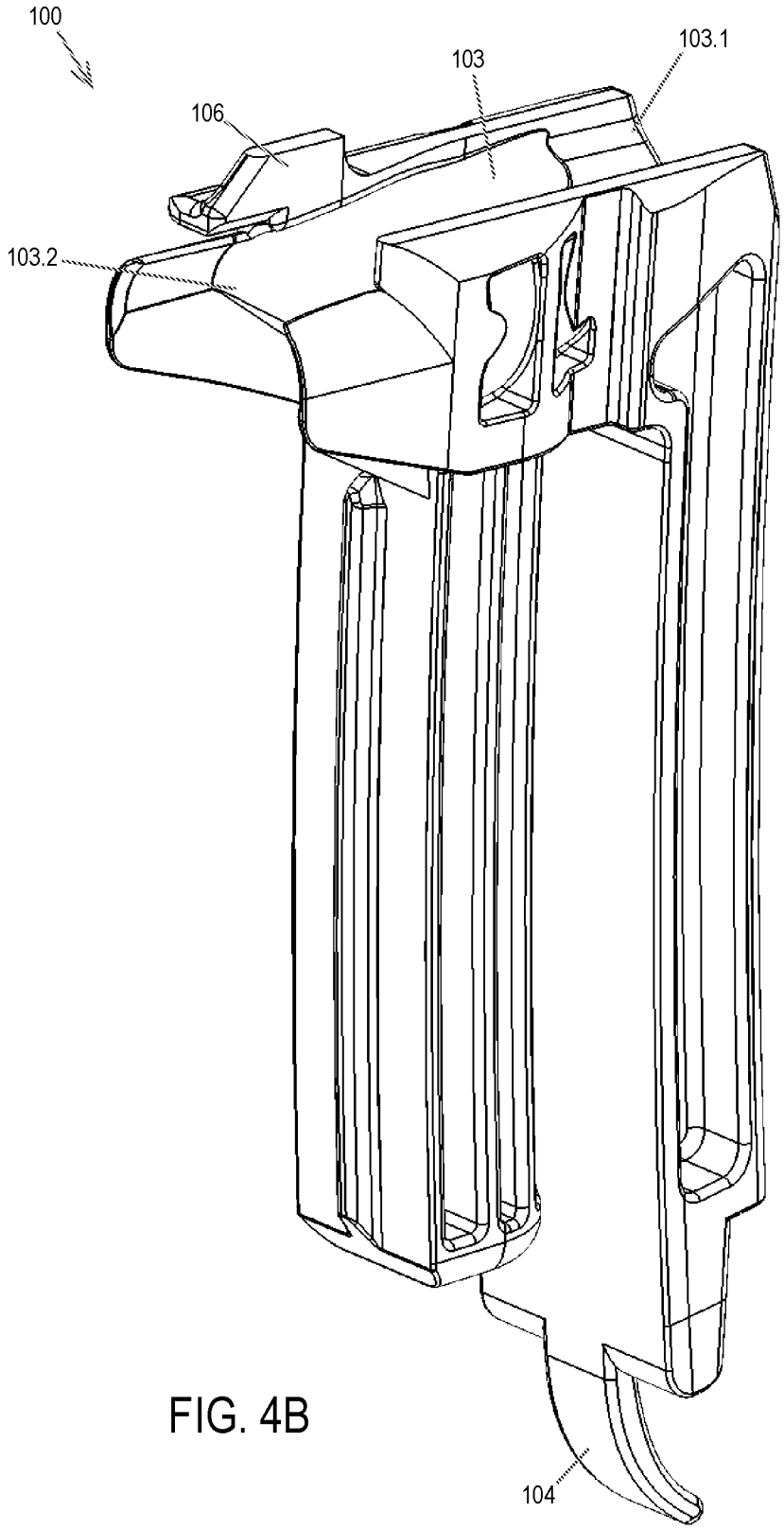

As shown in FIGS. 4A and 4B, the insert 102 may include an ejector 106 located at the upper end of the insert 102 along one side of the channel 103. The ejector 106 may extend from an upper end of the insert 102. For some firearms, an ejector is a component of the firearm (e.g., such as part of a receiver), not a component of a magazine or a magazine assembly. In some cases, the ejector 106 may be manufactured as an integral component of the insert 102 and/or, in some embodiments, may be molded as a polymer component. During operation of a firearm, after a projectile is fired from a cartridge, the empty shell is removed from the chamber by a spring loaded extractor 305 which is contained within the bolt carrier group 304 (see FIGS. 11A and 11B). In some embodiments, as the bolt carrier group 304 moves rearward, the extractor 305 pushes the shell until a portion of the shell contacts the ejector 106 (or ejector 306, as described below) such that the shell is ejected out of the firearm.

Figure 11A:
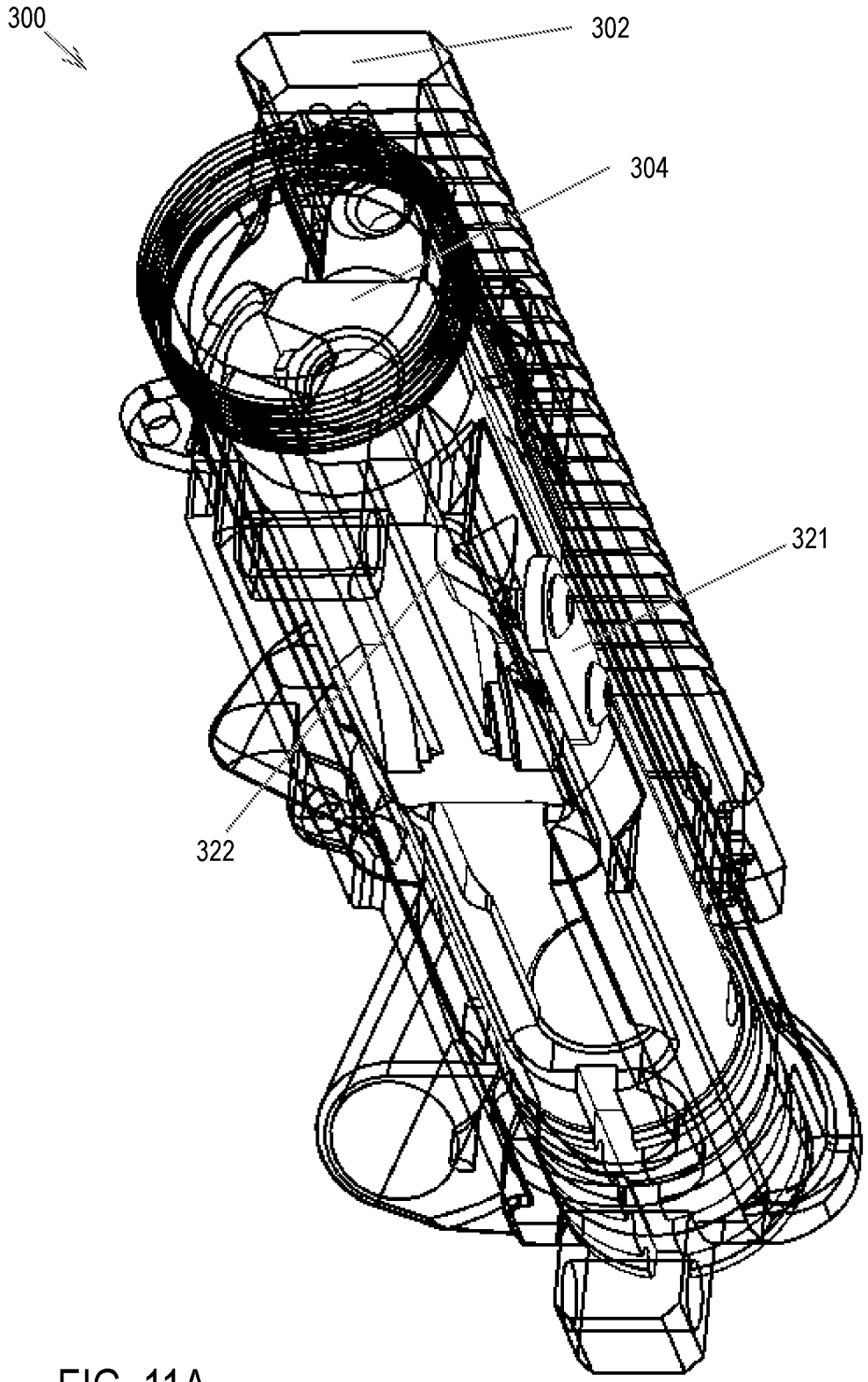
FIG. 11A is a perspective view of a firearm assembly that interfaces with a magazine assembly according to certain embodiments of the present invention.
Figure 11B:
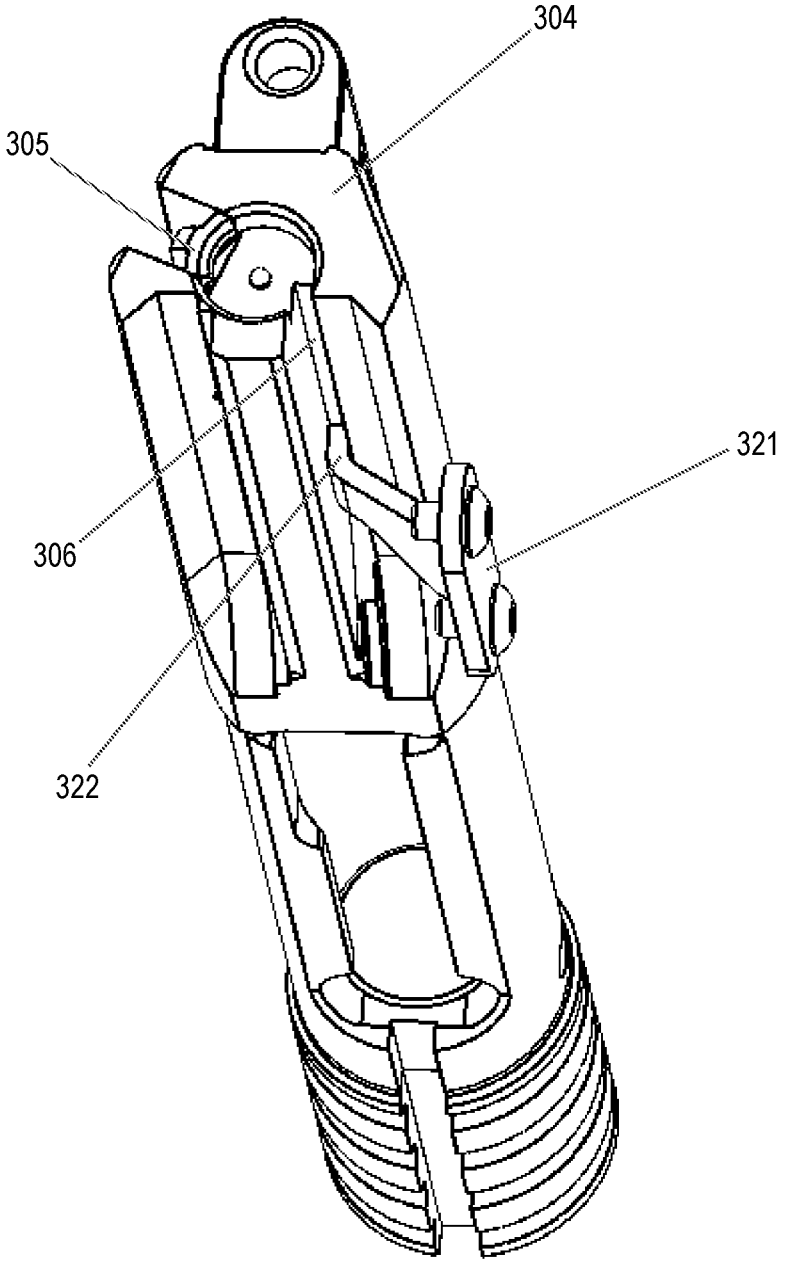
FIG. 11B is a perspective view of the firearm assembly of FIG. 11A without the upper receiver.
Figure 11C:
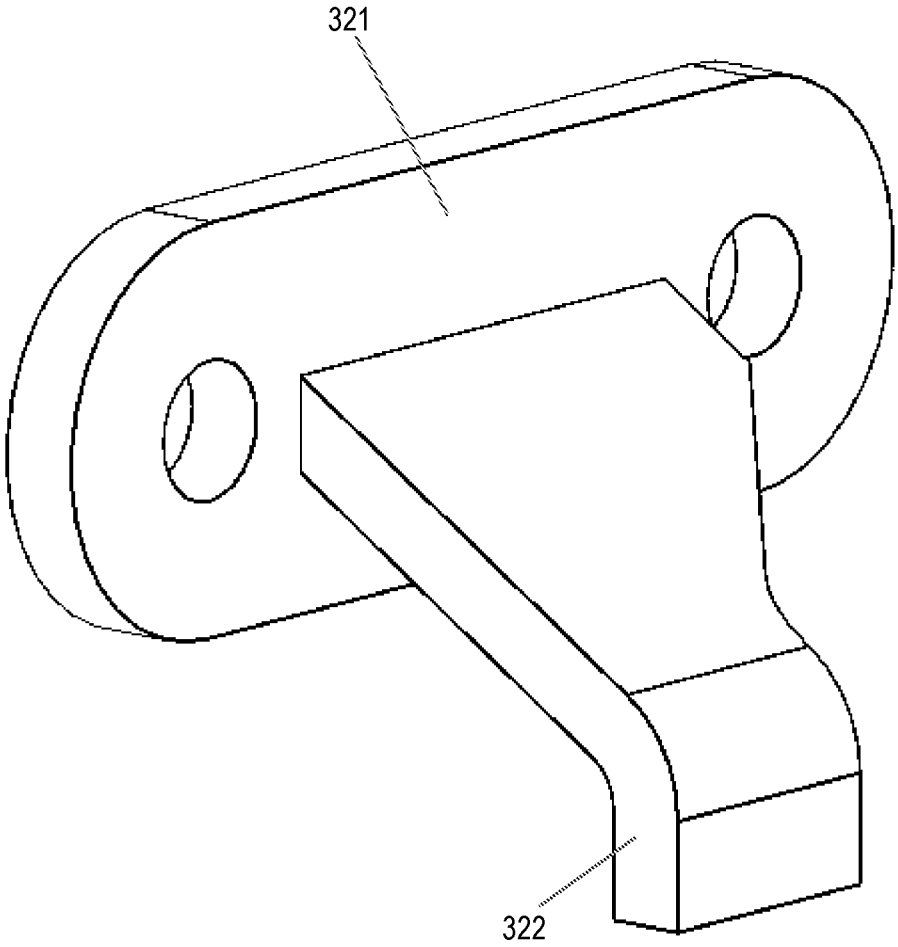
FIG. 11C is a perspective view of the ejector of the firearm assembly of FIG. 11A.

In some embodiments, as shown in FIGS. 11A-11C, the ejector 321 may be a separate component. The ejector 321 may be attached to an upper receiver 302 of the firearm. FIG. 11A shows a firearm assembly 300 that includes the bolt carrier group 304, the upper receiver 302, and the ejector 321. The ejector 321 may be arranged relative to the upper receiver 302 such that the arm 322 of the ejector 321 extends toward and is disposed within the ejection slot 306 of the bolt carrier group 304. For example, the ejector 321 may be attached to the left-hand side of the upper receiver 302 and may be oriented so that the arm 322 extends upwards into the slot 306. In some embodiments, the ejector 321 is disposed within the upper receiver 302 such that the arm 322 of the ejector 321 is positioned relative to the bolt carrier group 304 within the upper receiver 302 to eject the shell out of the firearm. The location of the ejector 321 relative to the upper receiver 302 may be adjusted based on the specific dimensions of the relevant components, the desired location for the start of the ejection sequence, or any other relevant factor. The ejector 321 may be attached to the receiver 302 using any suitable form of chemical or mechanical attachment including, but not limited to, nuts and bolts, screws, pins and rivets, a snap-fit connection, adhesive, welding, other mechanical fastener, and/or other chemical fasteners. The ejector 321 may be formed from any suitable material including carbon composite, plastic, thermoplastic, nylon, steel, aluminum, stainless steel, aluminum alloy, other plastic or polymer materials, other metallic materials, other composite materials, etc. Forming the ejector 321 from a metallic material may increase the durability of the ejector 321 and/or enable smaller and/or narrower ejectors 321 to be used while maintaining the necessary strength for the proper functioning of the firearm.

As described above, in some cases, the magazine assembly 100 may be retrofitted into a conventional magazine. The magazine assembly 100 may be assembled by disengaging the floorplate 12 of a conventional magazine and removing the conventional follower and spring from the conventional magazine. The conventional follower is detached from the spring and the follower 101 is attached to the top end of the spring (or the follower 101 may be attached to a replacement spring). The insert 102 is inserted into the main body 10 so that the channel 103 extends above the main body 10. The follower 101 is inserted into the main body and engages with the rear inner portion of the main body 10. In some embodiments, the length between the leading edge 101.1 of the follower and the trailing edge 101.2 of the follower 101 approximately corresponds to the distance between the rear side of the insert 102 and the rear end of the opening 11. The floorplate 12 is attached to the bottom end of the main body 10. Once the conventional magazine has been retrofitted with the magazine assembly 100, the magazine assembly 100 may be used in a similar manner as the conventional magazine. In some embodiments, an extension may be attached to the bottom end of the main body 10 and the floorplate 12 attached to the bottom end of the extension.

In some embodiments, a magazine assembly 200 may be located within a main body 10. The main body 10 is not shown in FIGS. 5-9B to better illustrate the components of the magazine assembly 200. According to certain embodiments of the present invention, the magazine assembly 200 may interface with a receiver of a firearm (not shown). The magazine assembly 200 may be a portable device capable of being inserted into and removed from a firearm (e.g., into a magazine well) or may be permanently attached. The magazine assembly 200 facilitates the loading of at least one round of ammunition into the firearm. The magazine assembly 200 may facilitate the loading of 10 rounds, 15 rounds, 20 rounds, 30 rounds, or any other desired number of rounds, as is discussed in further detail below.

Figure 5:
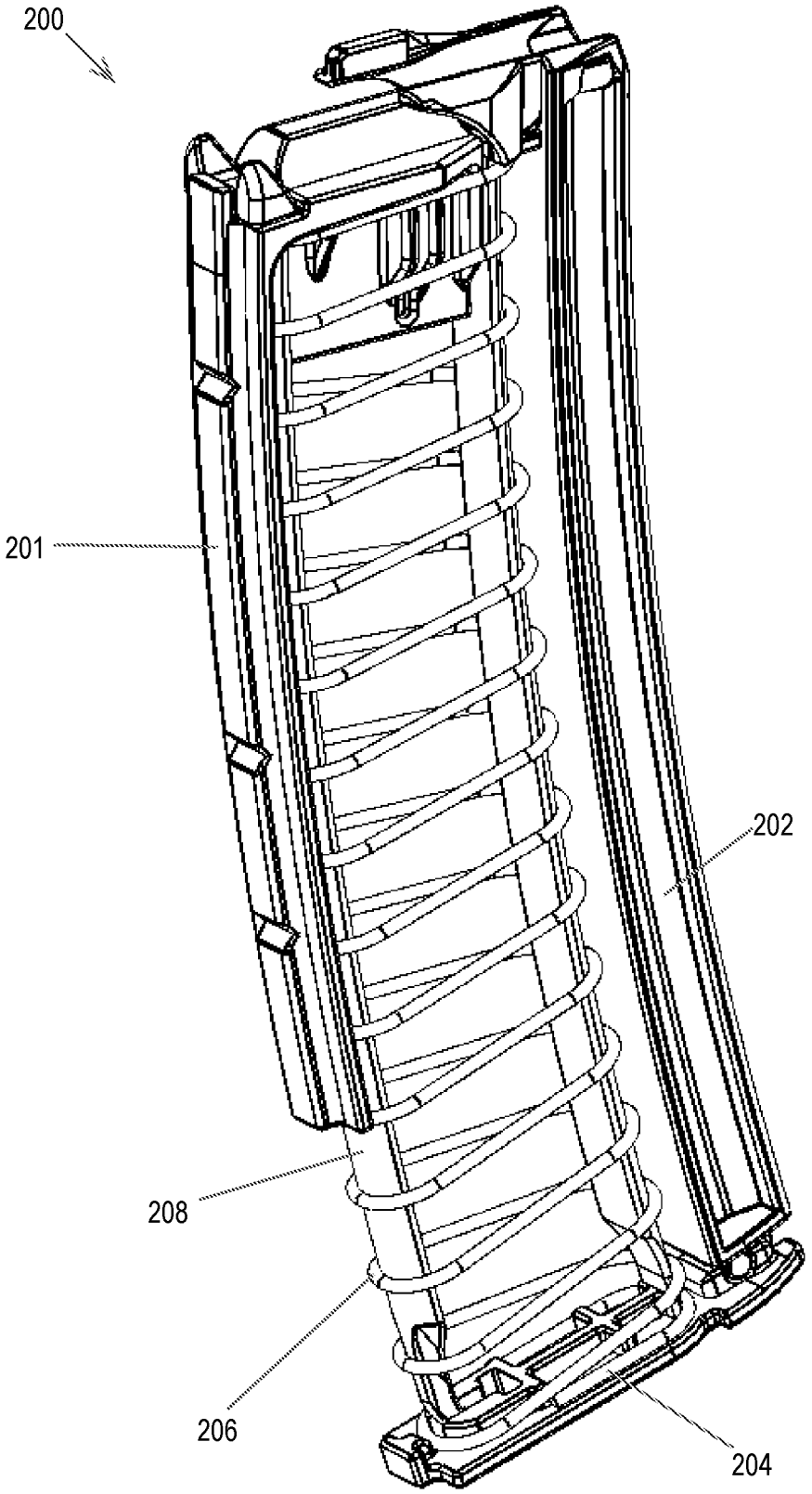
FIG. 5 is a perspective view of a magazine assembly, according to certain embodiments of the present invention.
Figure 6:
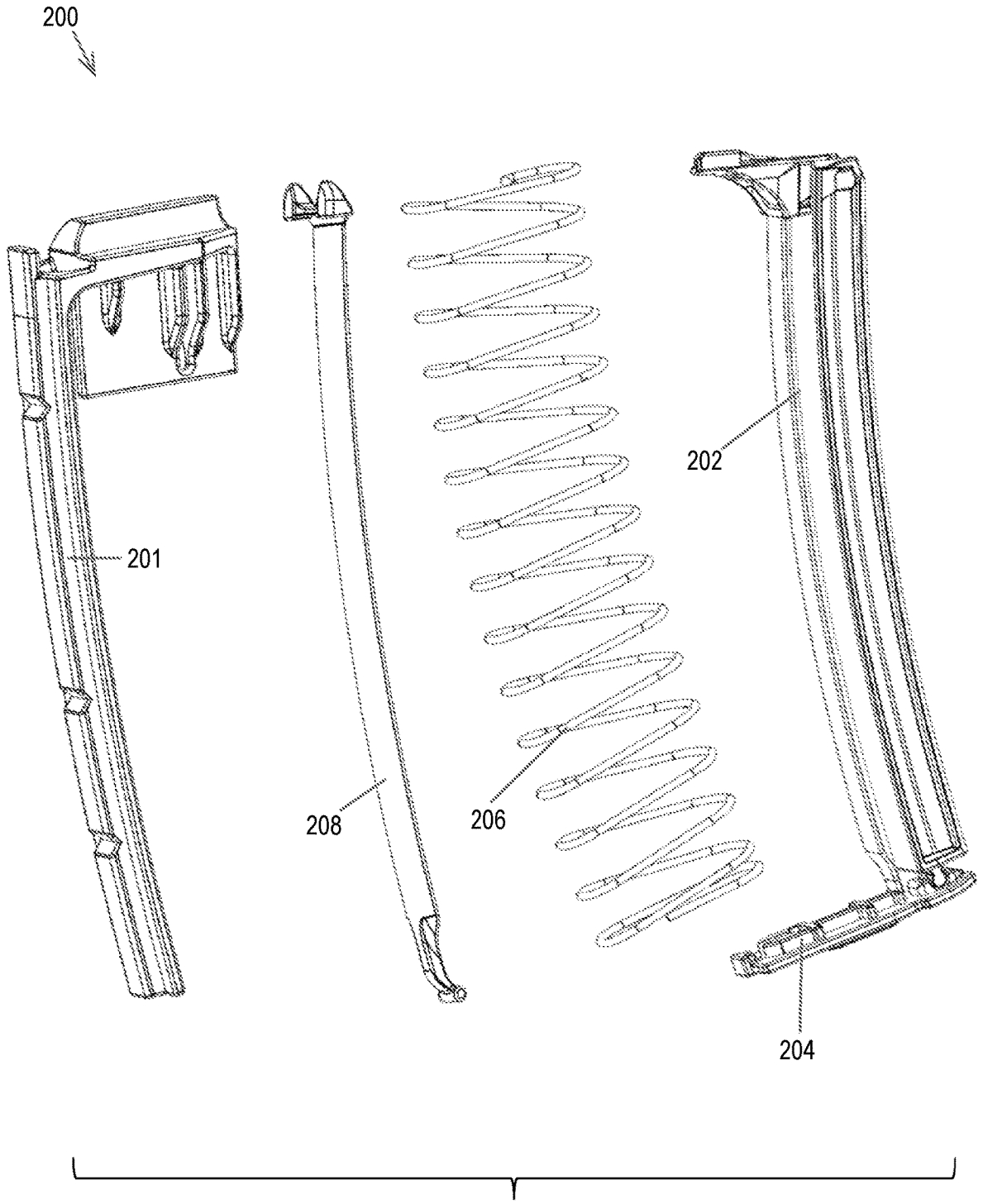
FIG. 6 is an exploded perspective view of the magazine assembly of FIG. 5.

In some embodiments, as shown in FIGS. 5 and 6, the magazine assembly 200 comprises a follower 201, an insert 202, a floorplate 204 flexibly coupled to the lower end of the insert 202, a spring 206 extending between the floorplate 204 and the follower 201, and a rear strap 208.

Figure 7A:
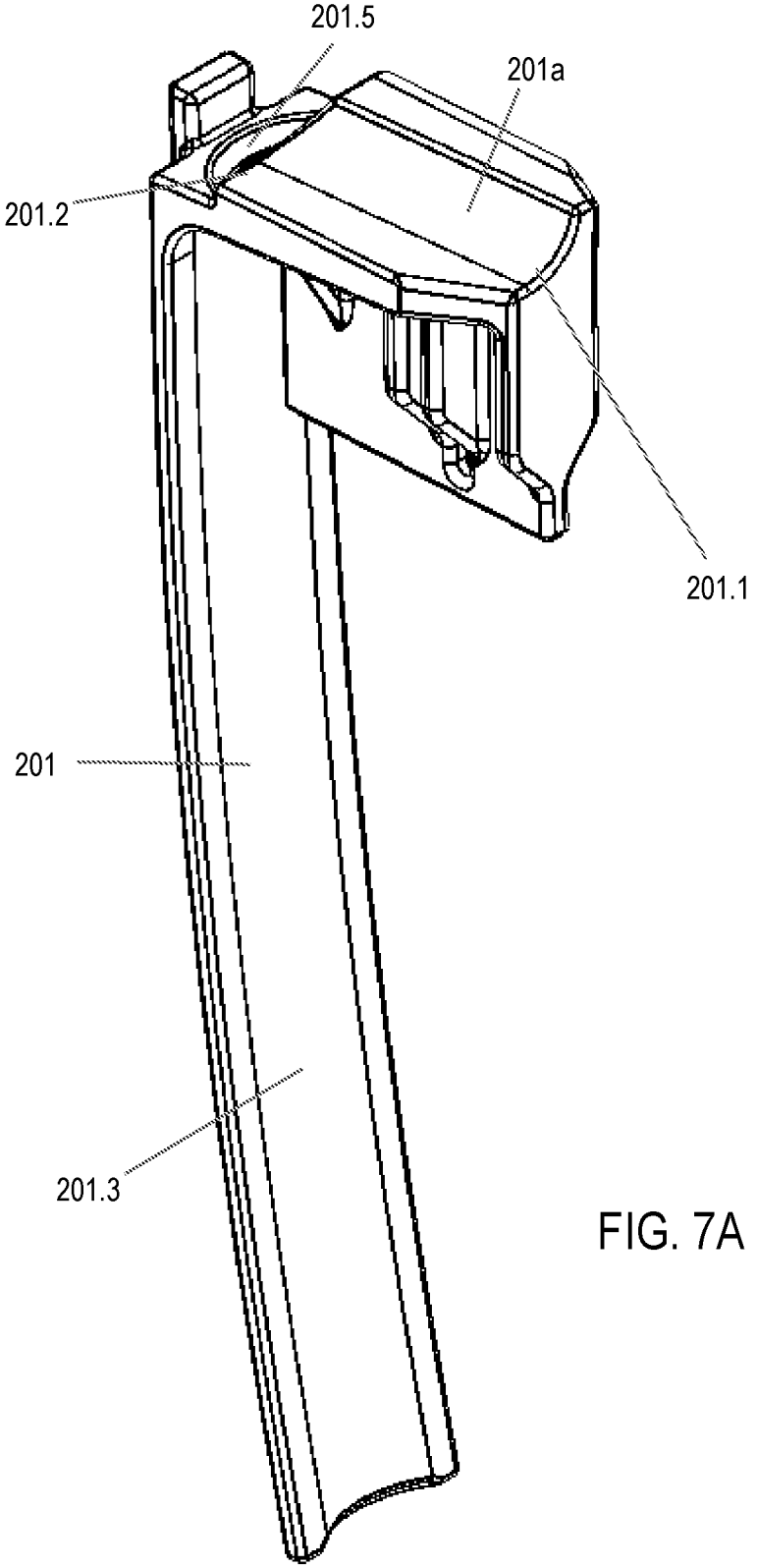
FIGS. 7A and 7B are perspective views of a follower of the magazine assembly of FIG. 5.
Figure 7B:
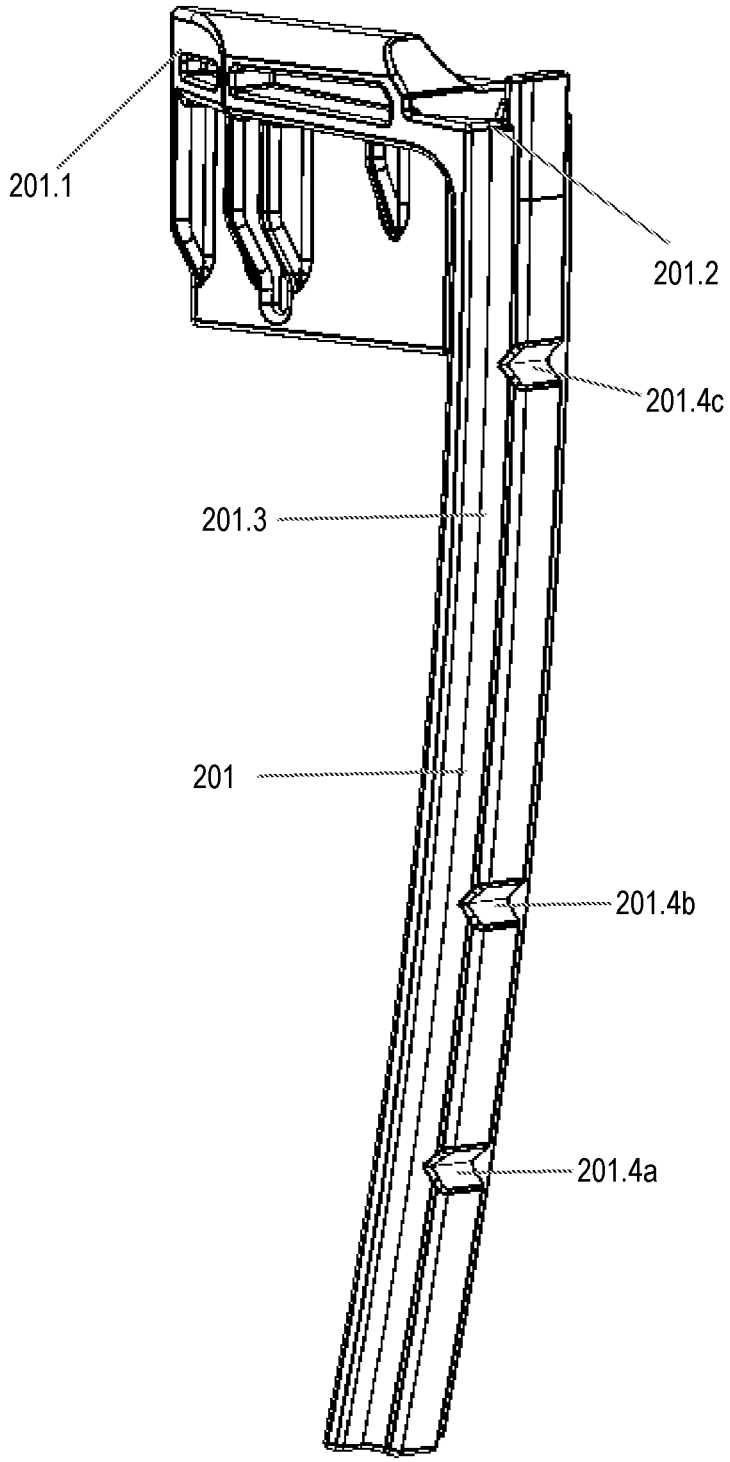

As shown in FIGS. 7A and 7B, the follower 201 may include an upper surface 201*a* for contacting the cartridge (s), a spine 201.3 extending vertically, at least one notch 201.4 located along the spine 201.3, and an opening 201.5. The upper surface 201*a* may include a leading edge 201.1 and a trailing edge 201.2. The follower 201 may attach to an upper portion of the spring 206 that extends between the follower 201 and the floorplate 204 such that the spring 206 may be attached to the underside of the follower 201. The follower 201 may be capable of moving vertically in relation to the insert 202. The lower end of the spine 201.3 may contact the floorplate 204 as the follower 201 moves vertically toward the lower end of the insert to define a maximum capacity for the magazine assembly 200.

In some embodiments, the size and features of the follower 201 correspond with the size of the insert 202 and the type or amount of ammunition chosen. For example, the follower 201 may include any number of notches 201.4 located along the spine 201.3. The notches 201.4 permit the magazine assembly 200 to be used with a variety of number of rounds by cutting the spine 201.3 at the desired notch 201.4 or by removing the material of the spine 201.3 below the desired notch 201.4. Cutting or removing the material of the spine 201.3 alters the lower end of the spine so that the maximum capacity of the magazine assembly 200 changes. For example, the follower 201 may be provided at a full length (as illustrated in FIGS. 5-7B) where the follower 201 is designed to allow 10 rounds to be inserted into the magazine. In some embodiments, the follower 201 can be cut at one of the notches 201.4 to allow for 15 rounds, 20 rounds, 30 rounds, or any other suitable number of rounds. For example, notch 201.4*a* may correspond to a 15 round configuration, notch 201.4*b* may correspond to a 20 round configuration, and notch 201.4*c* may correspond to a 30 round configuration. In some embodiments, the follower 201 is configured to operate with handgun caliber cartridges and the insert 202 is configured to reduce the length (i.e., distance between the leading and trailing ends) of an open area inside the main body 10 from a length appropriate for rifle caliber cartridges to a length appropriate for handgun caliber cartridges.

Figure 8A:
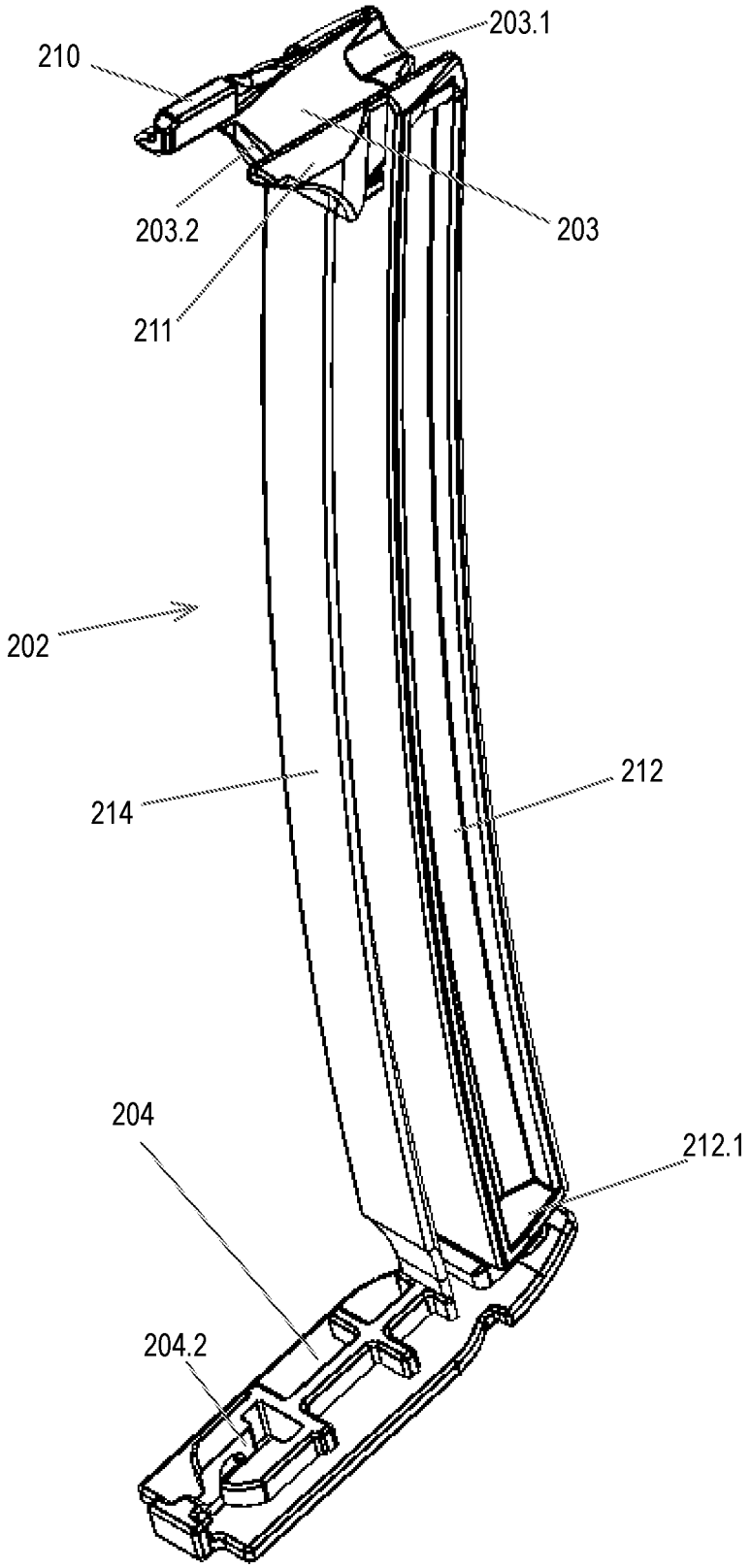
FIG. 8A is a perspective view of an insert of the magazine assembly of FIG. 5.
Figure 8B:
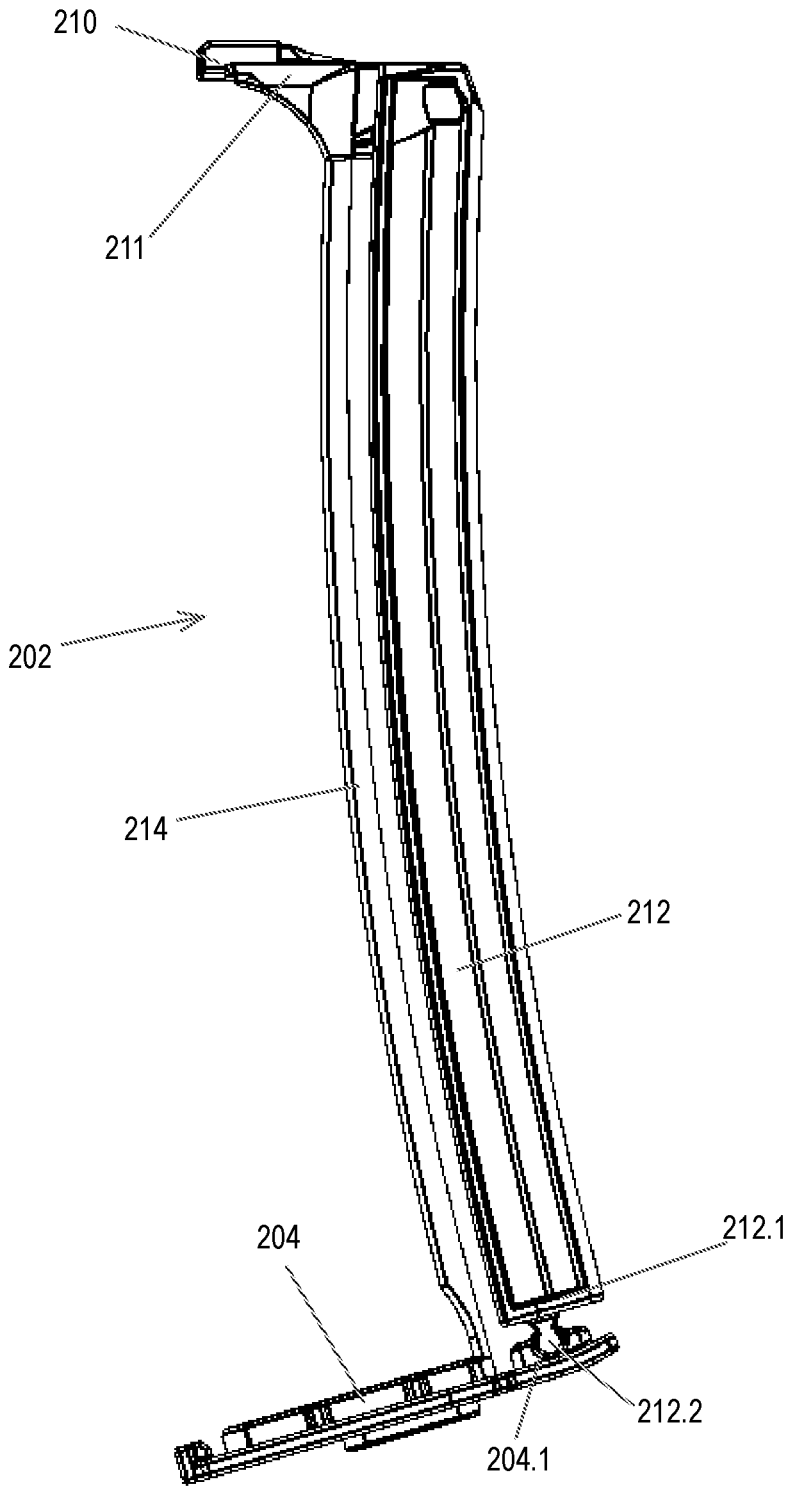
FIG. 8B is a side view of the insert of FIG. 8A.
Figure 8C:
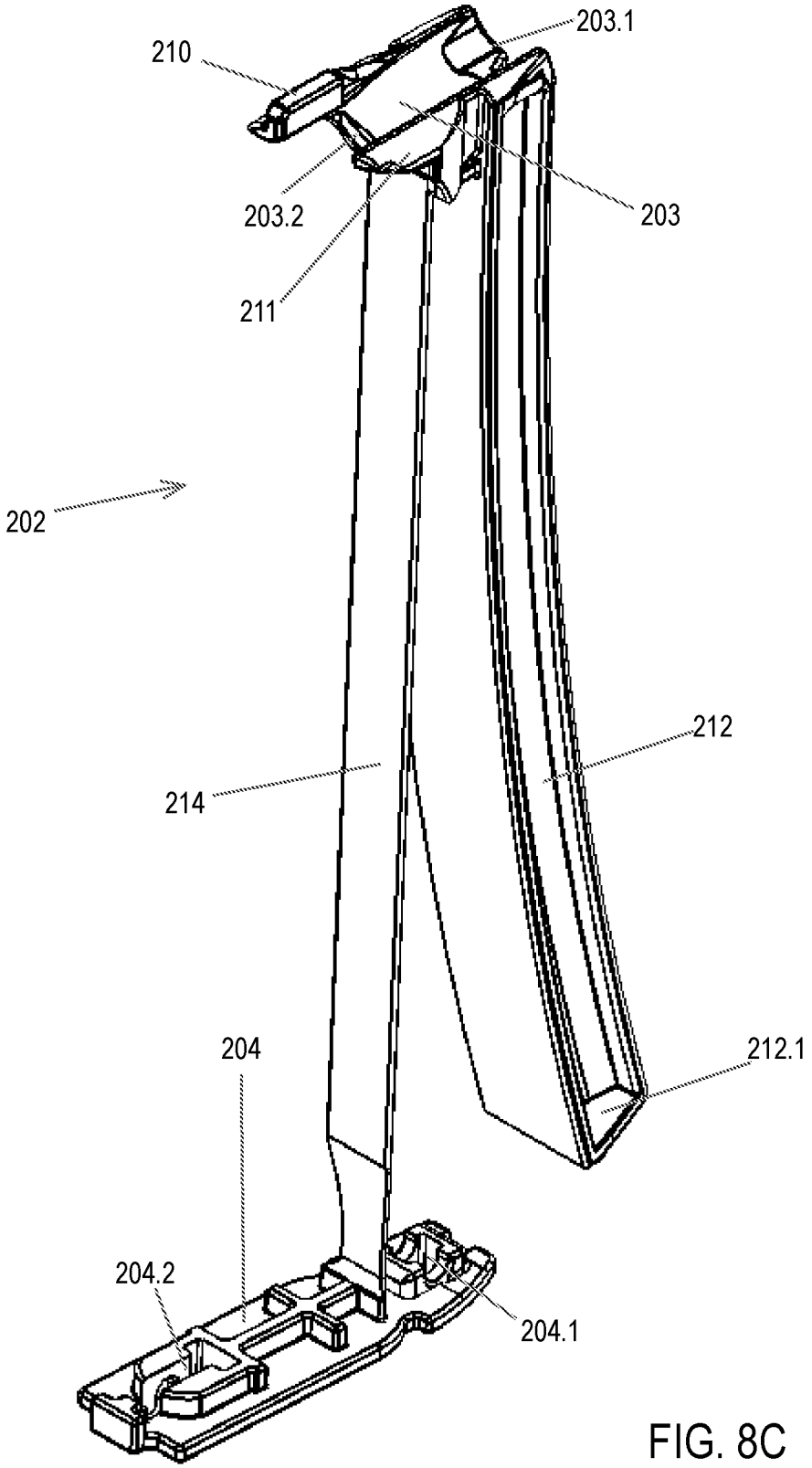
FIG. 8C is a perspective view of the insert of FIG. 8A with the leading member disengaged from the floorplate.

In some embodiments, as shown in FIGS. 8A-8D, the insert 202 may extend approximately a full height and a full width of the main body 10. The insert 202 does not extend a full length (front to rear) of the main body 10. The insert 202 alters the length of the open area inside the main body 10 (i.e., the length between a leading edge and a trailing edge of the main body 10). The insert 202 and follower 201 together approximately correspond to the length of the interior of the main body 10 (i.e., the length between the leading edge and the trailing edge). The insert 202 and the follower 201 may be available in multiple sizes/configurations in order accommodate a wide variety of ammunition. As shown in FIGS. 8A and 8C, the insert 202 may include a channel 203 at an upper end of the insert 202, a leading member 212, a dowel member 212.2, a front strap 214, and a floorplate 204.

In some cases, a portion of the channel 203 extends above the main body 10. The channel 203 guides the cartridge from the follower 201 toward the chamber as the cartridge moves forward. For example, in some embodiments, the bolt of the firearm (not shown) pushes the cartridge forward from the follower 201 into the channel 203. In some cases, the channel 203 acts as a feed ramp (or a portion of a feed ramp) where the cartridge moves through the channel 203 from the trailing edge 203.2 toward the leading edge 203.1 of the channel 203. In some embodiments, the channel 203 includes a ramp that provides additional guidance as the cartridge moves toward the chamber. The ramp is a compound, organic curve and longer than a normal ramp to allow the cartridge to enter the chamber at a shallow angle. Because the magazine assembly 200 is designed to function within a body of a magazine designed for rifle caliber cartridges and the cartridges are stored behind the insert 202 closer to a rear side of the magazine, the angle of the channel 203 is more gradual (i.e., less steep) compared to conventional magazines.

Figure 8D:
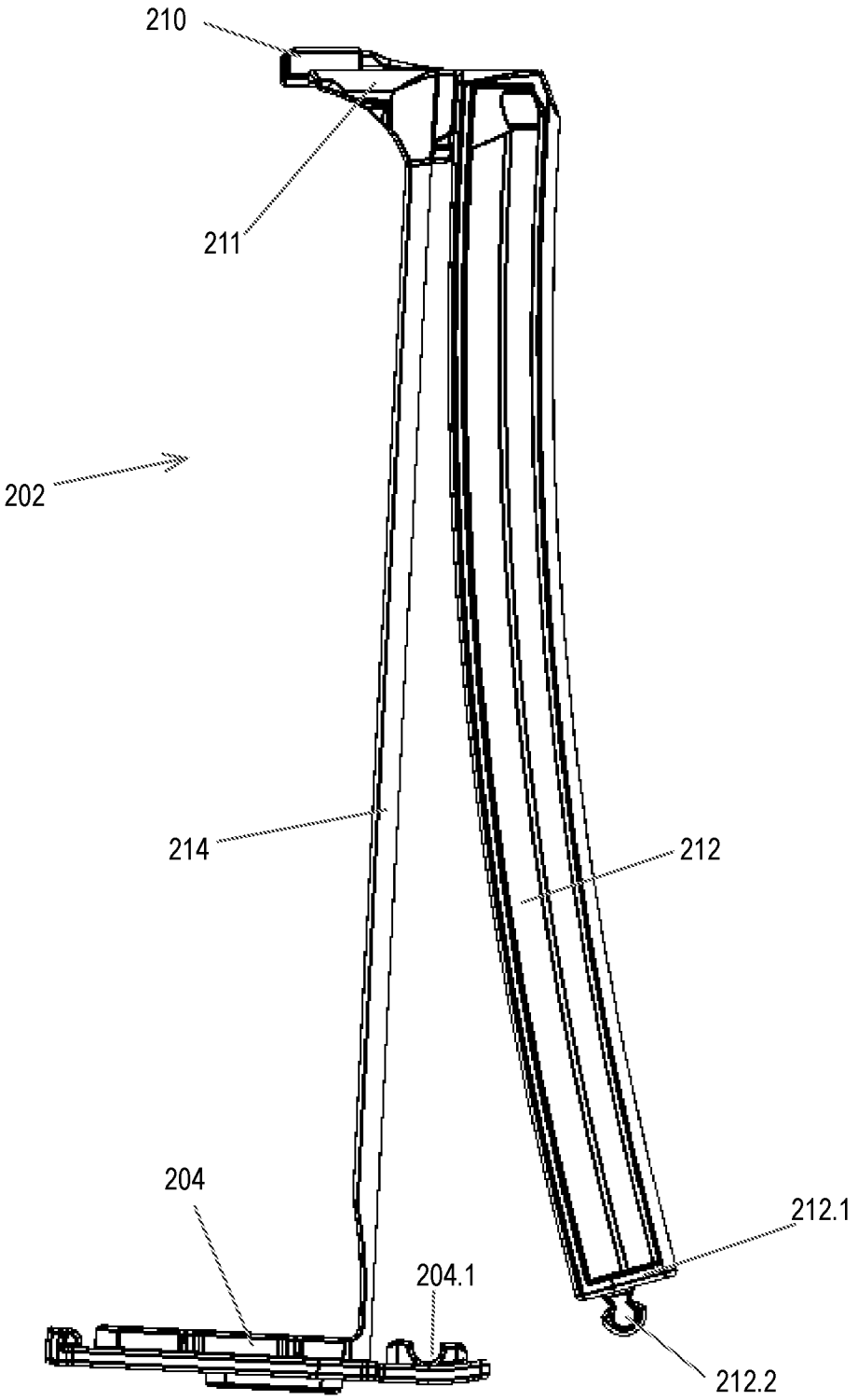
FIG. 8D is a side view of the insert of FIG. 8A with the leading member disengaged from the floorplate.
Figure 8E:
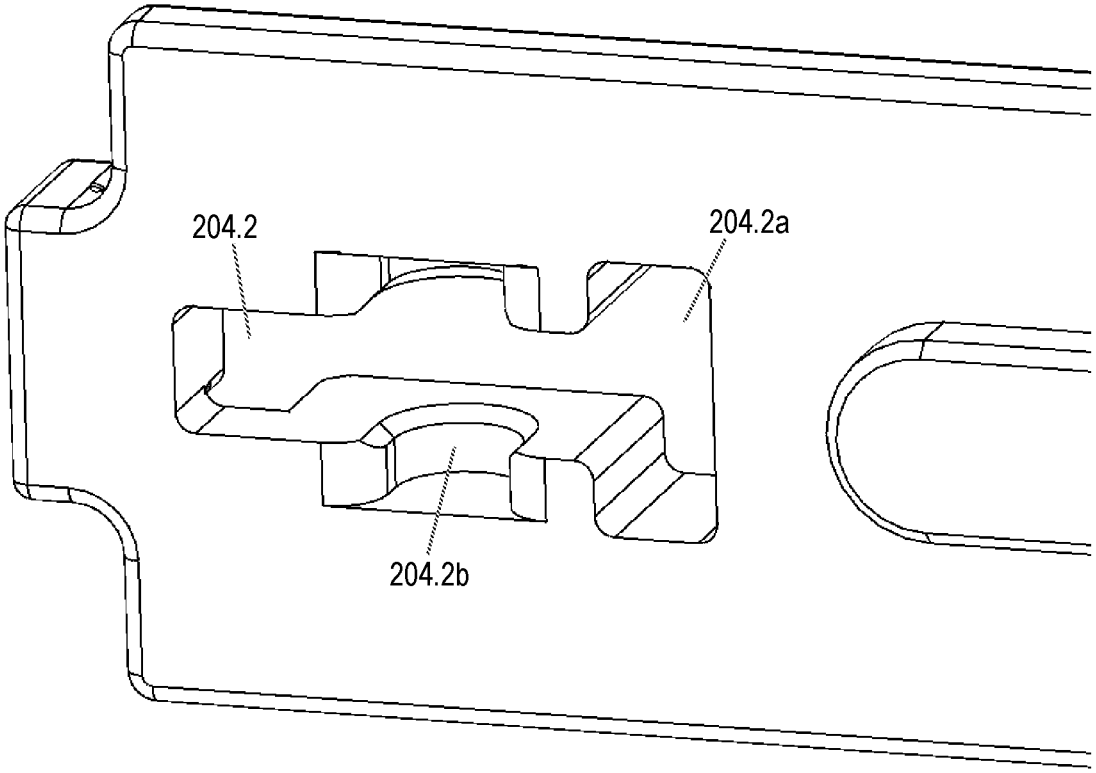
FIG. 8E is a bottom partial perspective view of a floorplate of the insert of FIG. 8A.
Figure 9A:
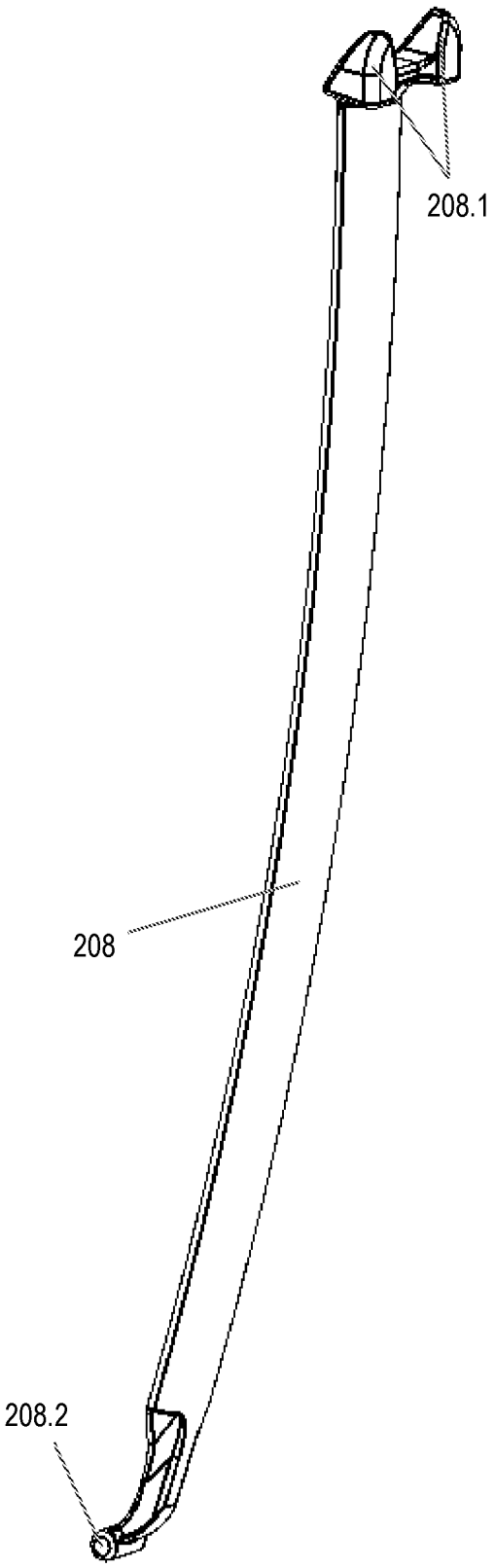
FIGS. 9A and 9B are perspective views of a rear strap of the magazine assembly of FIG. 5.
Figure 9B:
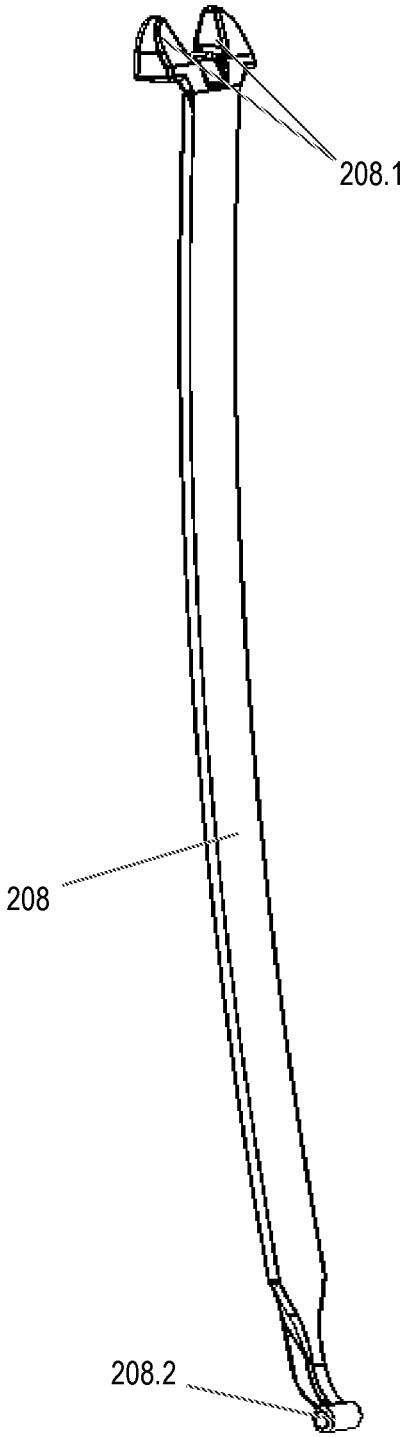

In some embodiments, the insert 202 may include a leading member 212 that extends the height of the insert 202. The leading member 212 may have a free end 212.1 that is movable with respect to the insert 202 and located at a lower end of the leading member 212. The free end 212.1 may include a dowel member 212.2, as illustrated in FIGS. 8B and 8D. The dowel member 212.2 may engage a corresponding front receptacle 204.1 of the floorplate 204. In some embodiments, the dowel member 212.2 removably engages the front receptacle 204.1, while in other embodiments, these components are permanently attached to one another. The interface between the dowel member 212.2 and the front receptacle 204.1 may be designed as a snap-fit or may be designed merely to locate the dowel member 212.2 relative to the floorplate 204 (in the fore/aft direction). Additionally, the insert 202 may include a front strap 214 that extends the height of the insert 202 and is attached to the floorplate 204. For example, the front strap 214 may be molded with a permanent attachment to the floorplate 204. In some embodiments, the front strap 214 is flexibly coupled to the floorplate 204 at a lower end of the front strap 214. In some cases, the insert 202 is fixed in position in the main body 10 when a baseplate (not shown) of the main body 10 pushes against the lower surface of the floorplate 204. The front strap 214 may define a forward limit for the spring 206 such that the front strap 214 is located inside the front side of the spring 206 and, as the spring 206 compresses (e.g., when cartridges are loaded into the magazine), the spring 206 follows the contour of the front strap 214. In some embodiments, the front strap 214 also prevents cartridges from moving too far forward (i.e., under the channel 203).

In some embodiments, the insert 202 may include a finger 211 and an ejector 210 both of which may extend from an upper end of the insert 202 and are disposed above the channel 203. The finger 211 and the ejector 210 assist in holding the magazine assembly 200 in place when the magazine assembly 200 is inserted into a main body 10. In some embodiments, to remove the magazine assembly 200 from the main body 10, the finger 211 and the ejector 210 must be pressed together in order for them to move past the feed lips of the main body 10.

For typical firearms, an ejector is a component of the firearm (e.g., such as part of a receiver or lower receiver), not a component of a magazine or a magazine assembly. In some cases, the ejector 210 may be manufactured as an integral component of the insert 202 and/or, in some embodiments, may be molded as a polymer component, though the ejector 210 may be made of any suitable material. By molding the ejector 210 out of a polymer, the ejector 210 may flex and adjust to different slots to allow for different bolt carriers to be used with the same magazine assembly 200. During operation of a firearm, after a projectile is fired from a cartridge, the empty shell is removed from the chamber by a spring loaded extractor 305 which is contained within the bolt carrier group 304 (see FIGS. 11A and 11B). In some embodiments, as the bolt carrier group 304 moves rearward, the extractor 305 pushes the shell until a portion of the shell contacts the ejector 210 (or ejector 306, as described above) such that the shell is ejected out of the firearm.

In some embodiments, as shown in FIGS. 5, 6, 9A, and 9B, the rear strap 208 extends the height of the insert 202. The rear strap 208 may include at least one protrusion 208.1 located on the uppermost end of the rear strap 208 and at least one cylindrical member 208.2 located at the lowermost end of the rear strap 208. In some embodiments, the at least one cylindrical member 208.2 may engage a corresponding rear receptacle 204.2 of the floorplate 204 to removably attach the rear strap 208 to the floorplate 204 (see FIGS. 8A, 8C, and 8E). The rear receptacle 204.2 may include an approximately T-shaped cross-section such that the at least one cylindrical member 208.2 may pass through lateral portion 204.2*a* (such that the at least one cylindrical member 208.2 is below the floorplate 204). The at least one cylindrical member 208.2 is then moved rearward until the at least one cylindrical member 208.2 is aligned with recess 204.2*b*. Tension from spring 206 creates sufficient pressure to secure the at least one cylindrical member 208.2 within the recess 204.2*b*. The rear strap 208 helps to keep the spring 206 in place when the magazine assembly 200 is inside the main body 10. Additionally, the rear strap 208 helps to keep the ammunition in the proper position, and, with the assistance of the front strap 214, helps to guide the ammunition as the ammunition moves up and down within the magazine assembly 200. The rear strap 208 may define a rear limit for the spring 206 such that the rear strap 208 is located inside the rear side of the spring 206 and, as the spring 206 compresses (e.g., when cartridges are loaded into the magazine), the spring 206 follows the contour of the rear strap 208. The at least one protrusion 208.1 will stop and press against the feed lips (not shown) of the main body 10 when the magazine assembly 200 is inserted into the main body 10. In some embodiments, the at least one protrusion 208.1 permits the rear strap 208 to keep the correct arch and prevents a user from loading the wrong type of ammunition, e.g., the wrong caliber of ammunition, into the magazine assembly 200. In addition, the at least one protrusion 208.1 may act as a barrier to prevent longer calibers from being loaded into the magazine assembly 200.

As described above, in some cases, the magazine assembly 200 may be installed into a conventional magazine (or into a conventional magazine body). The magazine assembly 200 may be assembled by flexing or pivoting the floorplate 204 relative to the front strap 214 so that the spring 206 may slide onto the insert 202 over the floorplate 204. The floorplate 204 and the front strap 214 may be inserted through the interior of the spring 206 (e.g., see FIG. 5). In some embodiments, the floorplate 204 is capable of pivoting such that the floorplate 204 is approximately parallel to the front strap 214. Additionally, the front strap 214 and the floorplate 204 may be rotated approximately 90° about a longitudinal axis (of the front strap 214) relative to the spring 206 to permit the front strap 214 and the floorplate 204 to pass through the spring 206. The spring 206 may be positioned in between the front strap 214 and the leading member 212 such that the front strap 214 is internal to the spring 206. After the floorplate 204 passes through the full height of the spring 206, the floorplate 204 may be released from its flexed position, which allows the floorplate 204 to return to its original position and retain the spring 206 on the insert 202. Once the spring 206 is in place with the front strap 214 located inside the spring 206, the leading member 212 may be flexed such that the free end 212.1 moves toward the front strap 214 and the dowel member 212.2 engages with the floorplate 204 (as described above). The follower 201 may engage with and/or attach to the upper portion of the spring 206. The rear strap 208 is inserted through an opening 201.5 in the follower 201 and through the spring 206 (see FIG. 5) until the cylindrical member 208.2 engages with the floorplate 204 (e.g., as described above). The magazine assembly 200 may be inserted into a main body 10 and a baseplate (not shown) may be attached to a lower end of the main body 10 to hold the magazine assembly 200 in the main body 10. Once the conventional main body 10 has been retrofitted with the magazine assembly 200, the magazine assembly 200 may be used in a similar manner as the conventional magazine. In some embodiments, the follower 201, the spring 206, the insert 202, and the rear strap 208 may be removed from the main body 10 by squeezing together the finger 211 and the ejector 210.

Figure 10A:
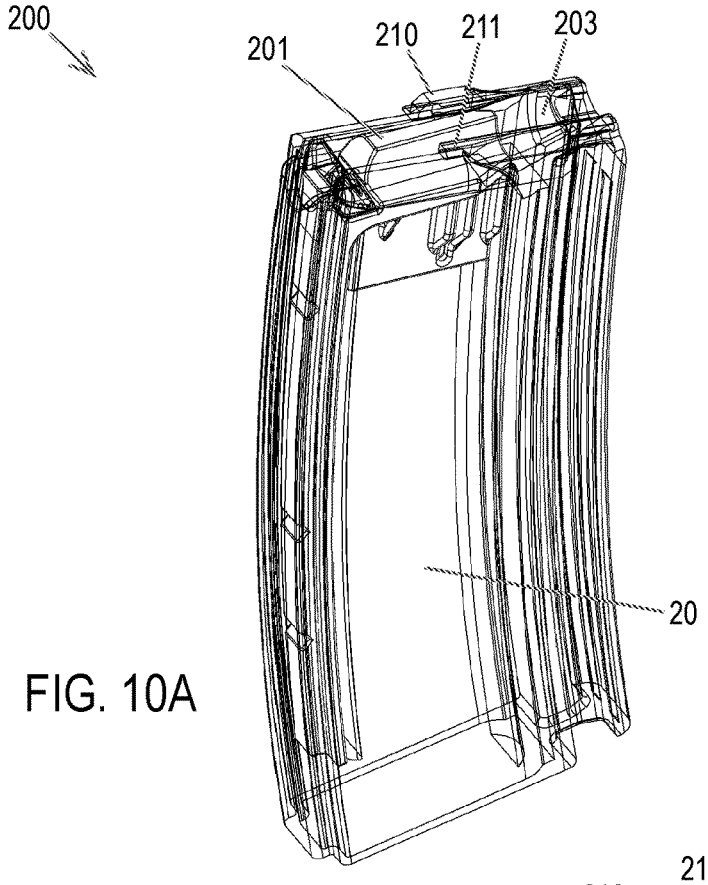
FIG. 10A is a perspective view of a magazine assembly, according to certain embodiments of the present invention.
Figure 10B:
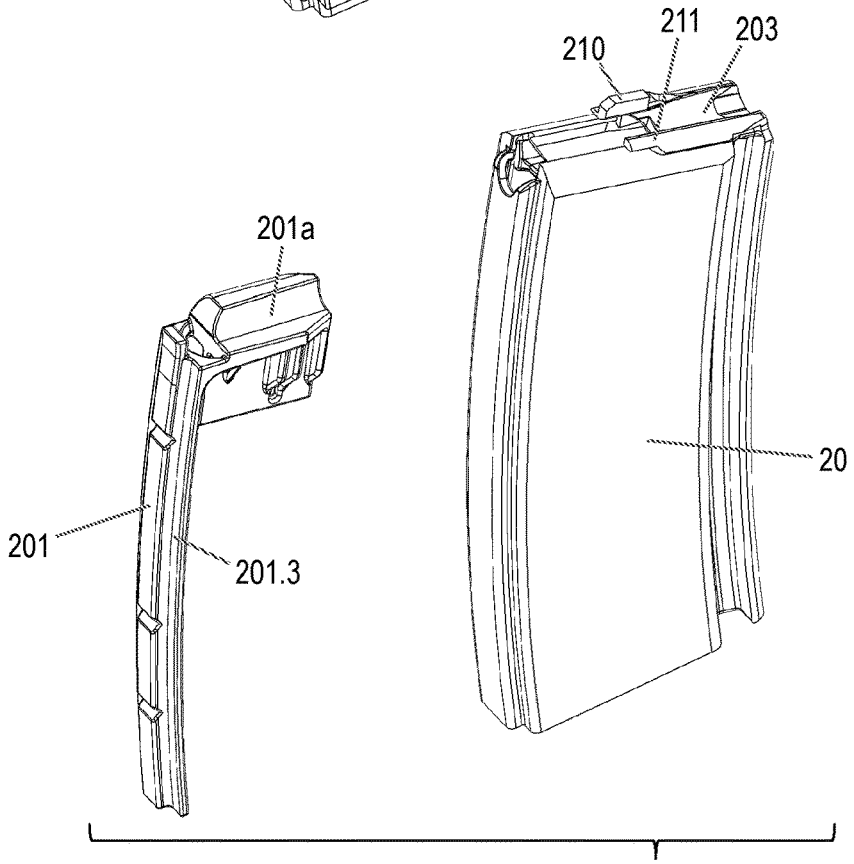
FIG. 10B is an exploded perspective view of the magazine assembly of FIG. 10A.

In some embodiments, as shown in FIGS. 10A and 10B, some or all of the components of the magazine assembly 200 may be integral to a magazine 20 such that some or all of the components of the magazine assembly 200 are molded, machined, or otherwise integrally included in the magazine 20. For example, the ejector 210 may be an integral component of the magazine (e.g., on a lip of the magazine 20). In some cases, some or all of insert 202 may also be an integral component of the magazine. The channel 203 and the finger 211 may also be an integral component of the magazine. In some embodiments, the magazine may be manufactured with integral protrusions that form a channel for guiding a cartridge through the magazine such that the integral protrusions correspond to front strap 214 and/or the rear strap 208. In some embodiments, where portions of the magazine assembly 200 are integral to a magazine, the spine 201.3 of the follower 201 is disposed inside the spring 206.

Figure 12A:
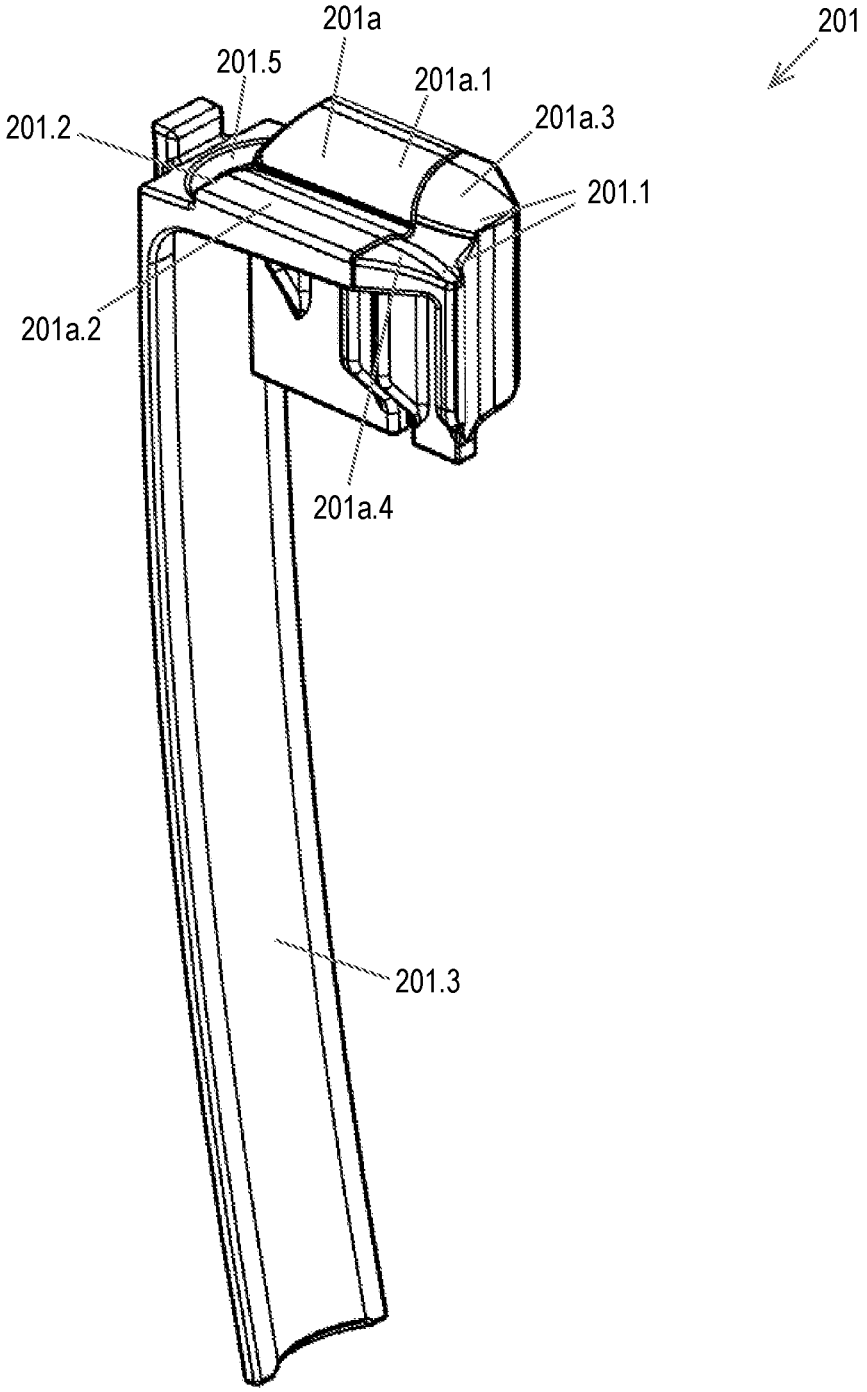
FIG. 12A is a perspective view of a follower of the magazine assembly of FIG. 5.
Figure 12B:
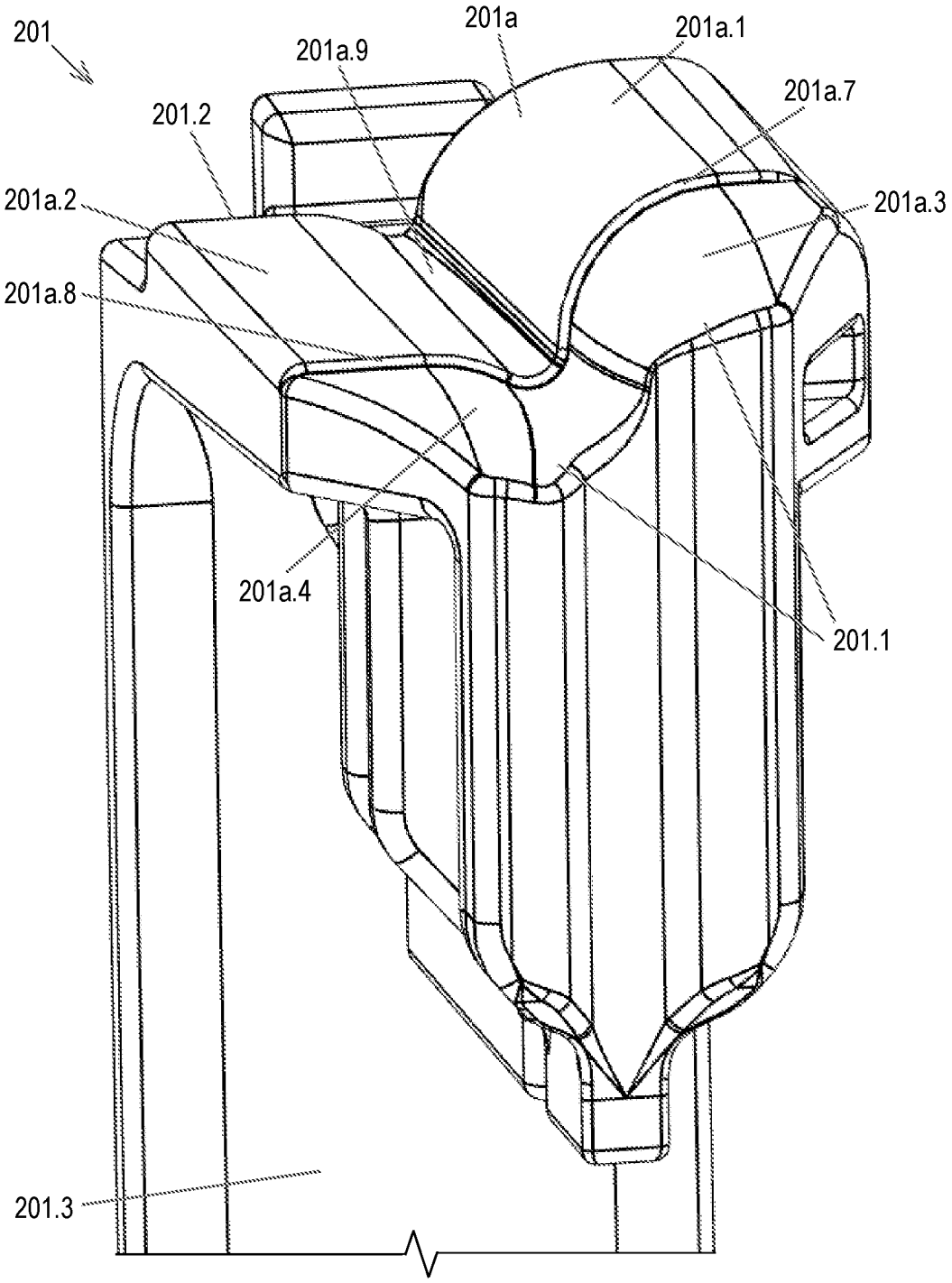
FIGS. 12B and 12C are partial perspective views of the follower of FIG. 12A.
Figure 12C:
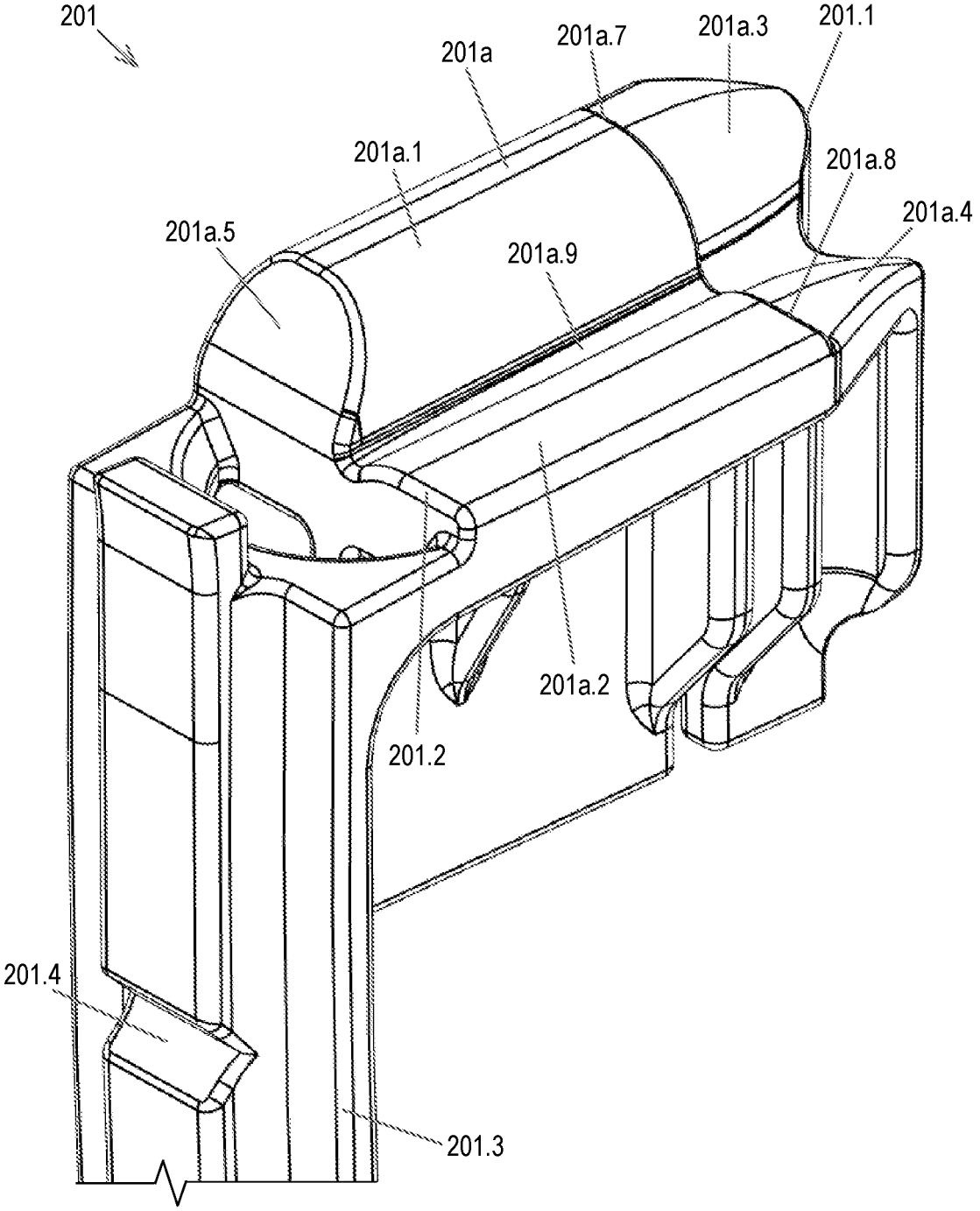

Although many of the illustrated embodiments of the follower 101, 201 show a follower with an upper surface that is concave (e.g., see FIGS. 3A, 3B, 7A, and 10B), as shown in FIGS. 12A-12C, the upper surface 201*a* may include at least one convex portion for interfacing with cartridge(s). The concave follower surface is designed to hold or cradle cartridge(s) while the convex follower surface is designed to simulate the shape of cartridge(s). The upper surface 201*a* may have a top portion 201*a*.1 and a bottom portion 201*a*.2. As shown in FIGS. 12B and 12C, the top portion 201*a*.1 may have a convex shape and, in some cases, may have a curved shape. In some embodiments, the top portion 201*a*.1 includes (i) a cylindrical shape between the trailing edge 201.2 and a transition portion 201*a*.7 and (ii) a conical portion 201*a*.3 extending from the transition portion 201*a*.7 to the leading edge 201.1. The top portion 201*a*.1 may be designed to mimic the shape of a cartridge (i.e., a static cartridge attached to the top of the follower) where the transition portion 201*a*.7 corresponds to the forward edge of the case and the initial exposed portion of the bullet. As shown in FIG. 12C, at the trailing end of the top portion 201*a*.1, the upper surface 201*a* may include a tapered portion 201*a*.5 that extends downward and rearward. In some cases, the tapered portion 201*a*.5 is approximately flat, but this is not always the case. The tapered portion 201*a*.5 may reduce the effect of any potential contact between the bolt carrier group and the follower 201. In some cases, the tapered portion 201*a*.5 may allow a cartridge to tilt (where the rear end of the cartridge tilts downward) as the cartridge exits the magazine.

The bottom portion 201*a*.2 may have a convex shape and, in some cases, may have a curved shape. The bottom portion 201*a*.2 may include a curved portion (proximate to the top portion 201*a*.1) and a second portion with less curvature (or may be approximately flat) distal from the top portion 201*a*.1. In some embodiments, the bottom portion 201*a*.2 includes (i) a cylindrical shape between the trailing edge 201.2 and a transition portion 201*a*.8 and (ii) a conical portion 201*a*.4 extending from the transition portion 201*a*.8 to the leading edge 201.1. The bottom portion 201*a*.2 may be designed to mimic the shape of a cartridge (i.e., a static cartridge attached to the top of the follower) where the transition portion 201*a*.8 corresponds to the forward edge of the case and the initial exposed portion of the bullet. In some embodiments, the upper surface 201*a* includes a valley 201*a*.9 between the top portion 201*a*.1 and the bottom portion 201*a*.2. In other words, the surfaces of both the top portion 201*a*.1 and the bottom portion 201*a*.2 slope downward to the valley 201*a*.9. When a cartridge is inserted into the magazine, the cartridge may contact a portion of the top portion 201*a*.1 and a portion of the bottom portion 201*a*.2. In addition, as the cartridge moves away from the follower (i.e., when the cartridge is pushed off the follower by a the bolt carrier group), the valley 201*a*.9 controls the direction of the cartridge. In other words, as the cartridge moves forward relative to the upper surface 201*a*, the cartridge moves toward the lateral center of the upper surface 201*a* because the rear end of the cartridge falls into valley 201*a*.9. In some embodiments, rear end of the cartridge moves toward the lateral center of the upper surface 201*a* when other portions of the cartridge are contacting the feed ramp (where the feed ramp may be a feature of the magazine or of another portion of the firearm).

The components of the magazine assembly 100, 200 described herein may be formed of materials including, but not limited to, carbon composite, plastic, thermoplastic, nylon, steel, aluminum, stainless steel, aluminum alloy, other plastic or polymer materials, other metallic materials, other composite materials, or other similar materials. Moreover, the components of the firearms may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A follower for a magazine of a firearm, the follower comprising:

an underside for attachment to a spring within the magazine;

a spine extending downward from a rear part of the follower; and an upper surface for interfacing with at least one cartridge inserted into the magazine, wherein:

the upper surface comprises a top portion and a bottom portion;

the bottom portion comprises a curved surface and at least a portion of the curved surface comprises a cylindrical surface;

the upper surface is static relative to the follower; and the follower is configured to slide vertically within the magazine.

2. The follower of claim 1, wherein the upper surface comprises a convex surface.

3. The follower of claim 1, wherein at least a portion of the curved surface of the bottom portion comprises a conical surface.

4. The follower of claim 1, wherein the top portion and the bottom portion form a continuous surface of the upper surface.

5. The follower of claim 1, wherein at least a portion of the top portion comprises a curved cylindrical surface.

6. The follower of claim 1, wherein at least a portion of the top portion comprises a curved conical surface.

7. The follower of claim 1, wherein the top portion comprises a transition portion between a curved cylindrical surface and a curved conical surface.

8. The follower of claim 1, wherein the top portion and the bottom portion are integrally formed as part of the follower.

9. The follower of claim 1, wherein the spine comprises at least one notch for cutting the spine to a desired length.

10. The follower of claim 1, wherein at least one selected from the group of the top portion and the bottom portion comprises a shape simulating at least a portion of a cartridge.

11. The follower of claim 1, wherein the follower is designed for at least one caliber selected from the group of 9×19 mm, .45 ACP, .40 S&W, .380 ACP, .38 ACP, .38 Super, and .22 Long Rifle.

12. A magazine for a firearm, the magazine comprising:

a follower; and a spring attached to an underside of the follower, wherein the follower comprises:

a spine extending downward from a rear part of the follower; and an upper surface for interfacing with at least one cartridge inserted into the magazine, wherein:

the upper surface comprises a top portion and a bottom portion; and the bottom portion comprises a curved surface and at least a portion of the curved surface comprises a cylindrical surface;

the top portion and the bottom portion form a continuous surface of the upper surface; and the magazine is configured to hold a plurality of cartridges.

13. The magazine of claim 12, wherein the upper surface comprises a convex surface.

14. The magazine of claim 12, wherein at least a portion of the curved surface of the bottom portion comprises a conical surface.

15. The magazine of claim 12, wherein the upper surface is static relative to the follower.

16. The magazine of claim 12, wherein at least a portion of the top portion comprises a curved cylindrical surface.

17. The magazine of claim 12, wherein at least a portion of the top portion comprises a curved conical surface.

18. The magazine of claim 12, wherein the top portion comprises a transition portion between a curved cylindrical surface and a curved conical surface.

19. The magazine of claim 12, wherein the upper surface comprises a tapered portion wherein the tapered portion extends downward and rearward.

20. The magazine of claim 12, wherein the top portion and the bottom portion are integrally formed as part of the follower.

21. A follower for a magazine of a firearm, the follower comprising:

an underside for attachment to a spring within the magazine;

a spine extending downward from a rear part of the follower; and an upper surface for interfacing with at least one cartridge inserted into the magazine, wherein:

the upper surface comprises a top portion and a bottom portion;

the bottom portion comprises a curved surface and at least a portion of the curved surface comprises a cylindrical surface;

the upper surface is static relative to the follower; and the spine comprises at least one notch for cutting the spine to a desired length.

* * * * *